US009263178B2

(12) United States Patent
Takahashi

(10) Patent No.: US 9,263,178 B2
(45) Date of Patent: Feb. 16, 2016

(54) COIL STRUCTURE AND ELECTRIC POWER CONVERSION DEVICE

(71) Applicant: Panasonic Intellectual Property Management Co., Ltd., Osaka (JP)

(72) Inventor: Eiji Takahashi, Nara (JP)

(73) Assignee: PANASONIC INTELLECTUAL PROPERTY MANAGEMENT CO., LTD, Osaka (JP)

( * ) Notice: Subject to any disclaimer, the term of this patent is extended or adjusted under 35 U.S.C. 154(b) by 0 days.

(21) Appl. No.: 14/678,001

(22) Filed: Apr. 3, 2015

(65) Prior Publication Data

US 2015/0302977 A1 Oct. 22, 2015

(30) Foreign Application Priority Data

Apr. 16, 2014 (JP) ..... 2014-084470

(51) Int. Cl.
*H01F 27/30* (2006.01)
*H01F 27/29* (2006.01)

(52) U.S. Cl.
CPC ..... *H01F 27/29* (2013.01); *H01F 27/30* (2013.01)

(58) Field of Classification Search
CPC ..... H01F 5/00; H01F 27/00–27/36
USPC ..... 336/65, 83, 192, 196, 198, 200, 232
See application file for complete search history.

(56) References Cited

U.S. PATENT DOCUMENTS 4,405,913 A * 9/1983 Finkbeiner ..... H01F 27/306 336/198
2008/0079525 A1* 4/2008 Sundaram ..... H01F 27/289 336/182
2013/0049913 A1* 2/2013 Kobayashi ..... H01F 27/027 336/90

FOREIGN PATENT DOCUMENTS

JP 2007-103974 4/2007

* cited by examiner

*Primary Examiner* — Tuyen Nguyen
(74) *Attorney, Agent, or Firm* — McDermott Will & Emery LLP

(57) ABSTRACT

Disclosed is a coil structure including: a first wire rod including a first coil portion and a first lead wire connected to the first coil portion, the first coil portion winding around a coil axis in a first space; a second wire rod including a second coil portion, the second coil portion winding around the coil axis in a second space, the second space being aligned with the first space along the coil axis; and an insulating structure including a first insulating section that insulates the first coil portion from the second coil portion. The first lead wire portion extends through the second space. The insulating structure fixes the first lead wire portion at a position that is away from the second coil portion by not less than a minimum creepage distance between the first and second coil portions, the minimum creepage distance being defined by the first insulating section.

13 Claims, 22 Drawing Sheets

COIL STRUCTURE AND ELECTRIC POWER CONVERSION DEVICE

BACKGROUND

1. Technical Field

The present disclosure relates to a coil structure having a coil and an electric power conversion device in which the coil structure is incorporated.

2. Description of the Related Art

A coil structure has various applications such as a reactor, a transformer, and a motor. Japanese Unexamined Patent Application Publication No. 2007-103974 discloses a transformer as a coil structure.

The transformer of Japanese Unexamined Patent Application Publication No. 2007-103974 includes a flange to which a pin for fixing a lead wire drawn out from a coil is attached. The lead wire is wound around the pin.

SUMMARY

According to Japanese Unexamined Patent Application Publication No. 2007-103974, the flange markedly protrudes sideways. Therefore, the transformer of Japanese Unexamined Patent Application Publication No. 2007-103974 has a large dimension sideways.

One non-limiting and exemplary embodiment provides a technique for designing a small coil structure and a device including a coil structure.

In one general aspect, the techniques disclosed here feature a coil structure according to one aspect of the present disclosure including: a first wire rod including a first coil portion and a first lead wire portion, the first coil portion winding around a coil axis in a first space, the first lead portion being connected to the first coil portion; a second wire rod including a second coil portion, the second coil portion winding around the coil axis in a second space, the second space being aligned with the first space along the coil axis; and an insulating structure including a first insulating section, the first insulating section insulating the first coil portion from the second coil portion. The first lead wire portion extends through the second space. The insulating structure fixes the first lead wire portion at a position, the position being away from the second coil portion by not less than a minimum creepage distance between the first coil portion and the second coil portion, the minimum creepage distance being defined by the first insulating section.

It should be noted that general or specific embodiments may be implemented as a device, a system, or a method. The general or specific embodiments may be implemented as any combination of a device, a system, and a method.

The present disclosure can provide a technique for designing a small coil structure and a device including a coil structure.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
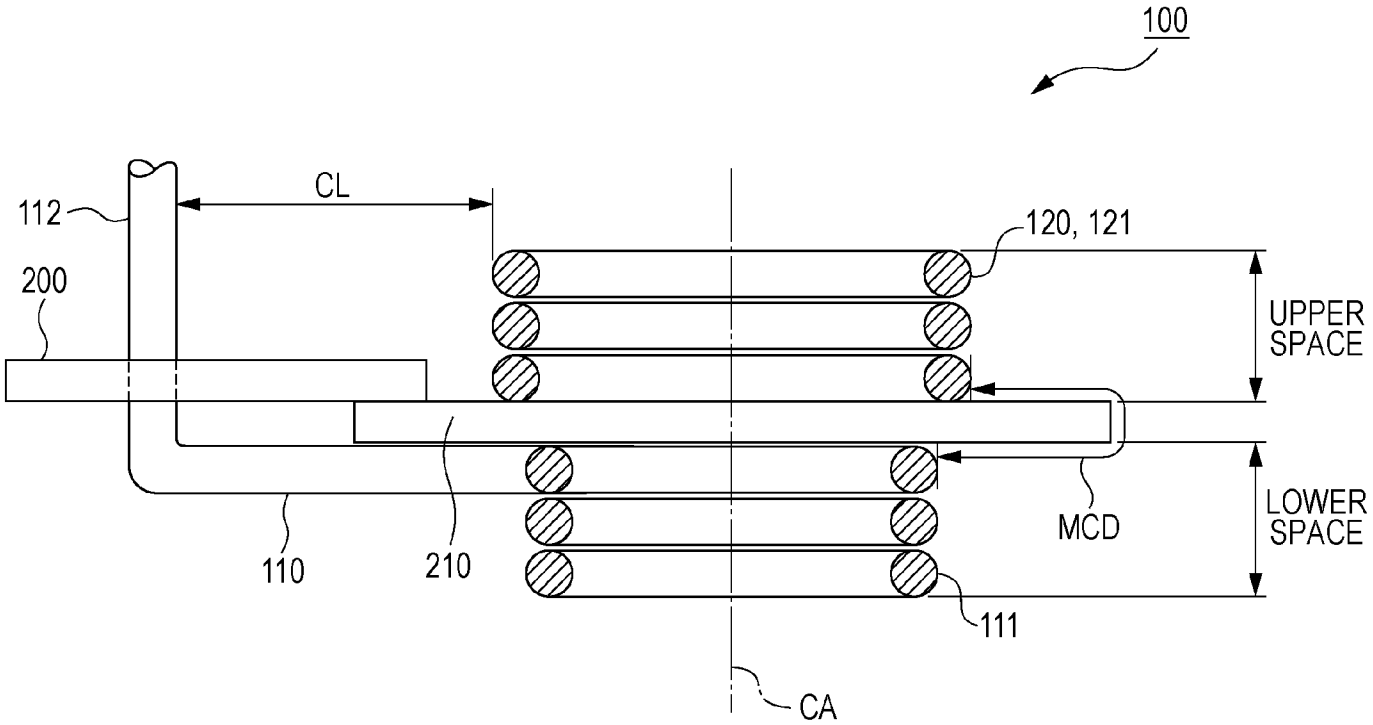
FIG. 1 is a conceptual diagram of a coil structure of First Embodiment.

A coil structure according to one aspect of the present disclosure includes a first wire rod including a first coil portion and a first lead wire portion, the first coil portion winding around a coil axis in a first space, the first lead portion being connected to the first coil portion; a second wire rod including a second coil portion, the second coil portion winding around the coil axis in a second space, the second space being aligned with the first space along the coil axis; and an insulating structure including a first insulating section, the first insulating section insulating the first coil portion from the second coil portion. The first lead wire portion extends through the second space. The insulating structure fixes the first lead wire portion at a position, the position being away from the second coil portion by not less than a minimum creepage distance between the first coil portion and the second coil portion, the minimum creepage distance being defined by the first insulating section.

According to the arrangement, the first lead wire portion extends through the second space in which the second coil portion is formed. It is therefore unnecessary for a designer to set an excessively large space for the first lead wire portion.

Since the insulating structure fixes the first lead wire portion at a position away from the second coil portion by not less than the minimum creepage distance between the first coil portion and the second coil portion defined by the first insulating section, the first lead wire portion is sufficiently insulated from the second coil portion.

In the above arrangement, the first insulating section may include a first surface, a second surface and an edge surface, the first surface facing the first coil portion, the second surface facing the second coil portion, the edge surface defining outer contours of the first surface and the second surface. The minimum creepage distance may be defined on a first plane on which a sum of a first creepage distance, a second creepage distance and a third creepage distance is minimum, the first creepage distance being a distance on the first surface between an outermost edge of the first coil portion and the edge surface, the second creepage distance being a distance on the second surface between an outermost edge of the second coil portion and the edge surface, the third creepage distance being a distance on the edge surface between the first surface and the second surface. The first lead wire portion may be fixed on a second plane different from the first plane.

According to the arrangement, since the first lead wire portion is fixed on the second plane different from the first plane at which the sum of the first creepage distance, the second creepage distance, and the third creepage distance is minimum, the first lead wire portion is sufficiently insulated from the second coil portion.

In the above arrangement, the first insulating section may include a first fixing edge that fixes the first lead wire portion.

According to the arrangement, since the first insulating section includes the first fixing edge that fixes the first lead wire portion, the first insulating section can have not only an insulating function for insulating the first coil portion from the second coil portion, but also a fixing function for fixing the first lead wire portion.

In the above arrangement, the first fixing edge may include a cutout portion being recessed in the edge surface. The first lead wire portion may be inserted into the cutout portion.

According to the arrangement, since the first lead wire portion is inserted into the cutout portion, the first lead wire portion is appropriately fixed.

In the above arrangement, the first fixing edge may include a through-hole penetrating the first insulating section from the first surface to the second surface. The first lead wire portion may be inserted into the through-hole.

According to the arrangement, since the first lead wire portion is inserted into the through-hole, the first lead wire portion is appropriately fixed.

In the above arrangement, the first wire rod may include a second lead wire portion being connected to the first coil portion, the second lead wire portion being connected to the first lead wire portion through the first coil portion. The second lead wire portion may extend through the second space. The first insulating section may include a second fixing edge that fixes the second lead wire portion.

According to the arrangement, since the first insulating section includes the second fixing edge that fixes the second lead wire portion, the first insulating section can have not only an insulating function for insulating the first coil portion from the second coil portion, but also a fixing function for fixing the first lead wire portion and the second lead wire portion.

In the above arrangement, the second lead wire portion may sterically cross the first lead wire portion in the first space.

According to the arrangement, since the second lead wire portion sterically crosses the first lead wire portion in the first space, a leakage magnetic flux from the coil structure is small.

In the above arrangement, the second lead wire portion may extend from the first coil portion in a direction in which the second lead wire portion leaves from the first lead wire portion in the first space.

According to the arrangement, since the second lead wire portion extends from the first coil portion in a direction in which the second lead wire portion leaves from the first lead wire portion, a designer can set a large leakage magnetic flux from the coil structure.

In the above arrangement, the coil structure may further include a magnetic core that defines a magnetic path surrounding the first coil portion and the second coil portion. The insulating structure may include a second insulating section that faces the first insulating section, the second insulating section insulating the second coil portion from the magnetic core. The second insulating section may fix the first lead wire portion in cooperation with the first insulating section.

According to the arrangement, the second coil portion is appropriately insulated from the magnetic core by the second insulating section. The first lead wire portion can be appropriately fixed by the first insulating section and the second insulating section.

In the above arrangement, the insulating structure may include a terminal block that fixes the first lead wire portion.

According to the arrangement, the first lead wire portion is appropriately fixed by the terminal block.

In the above arrangement, the coil structure may further include a magnetic core that defines a magnetic path surrounding the first coil portion and the second coil portion. The magnetic core may include a magnetic leg located outside of the first coil portion and the second coil portion. The insulating structure may include a fixing member located between the magnetic leg and the edge surface, the fixing member fixing the first lead wire portion.

According to the arrangement, the first lead wire portion is appropriately fixed between the magnetic leg and the edge surface by the fixing member.

In the above arrangement, the second wire rod may include a third lead wire portion that is connected to the second coil portion, the third lead wire portion extending along a direction in which the first lead wire portion extends.

According to the arrangement, since the second wire rod includes the third lead wire portion that extends along a direction in which the first lead wire portion extends, a designer can easily connect the first wire rod and the second wire rod to a common substrate.

An electric power conversion device according to another aspect of the present disclosure includes the coil structure described above; and a switching circuit that includes a switching element.

According to the arrangement, a designer can design a small electric power conversion device by using the above coil structure.

Various embodiments concerning a coil structure and an electric power conversion device are described below with reference to the attached drawings. The coil structure and the electric power conversion device can be clearly understood by the following description. Terms that indicate directions such as "upper", "lower", "left", and "right" are merely used to clarify the description. These terms should not be interpreted in a limited way.

First Embodiment

A designer sometimes designs a coil structure in such a manner that two coil portions are aligned along a common coil axis. If a lead wire portion drawn out from one of the two coil portions passes through a space in which the other one of the two coil portions is provided, electrical connection with the coil structure is simplified. For example, the designer can electrically connect the two coil portions to a common substrate. In First Embodiment, a coil structure that contributes to a simplified electrical connection structure is described.

FIG. 1 is a conceptual diagram of a coil structure 100 of First Embodiment. The coil structure 100 is described with reference to FIG. 1.

The coil structure 100 includes a first wire rod 110, a second wire rod 120, and an insulating structure 200. The first wire rod 110 forms a lower coil portion 111 that winds around a coil axis CA. The second wire rod 120 forms an upper coil portion 121 that winds around the coil axis CA. One of the lower coil portion 111 and the upper coil portion 121 may be used as a primary winding to which an electric current is supplied. The other one of the lower coil portion 111 and the upper coil portion 121 may be used as a secondary winding in which an induced electric current is induced in accordance with supply of the electric current.

The upper coil portion 121 is aligned with the lower coil portion 111 along the coil axis CA. In the present embodiment, the coil axis CA is shared by the upper coil portion 121 and the lower coil portion 111. Alternatively, the upper coil portion 121 may have a central axis different from that of the lower coil portion 111.

The insulating structure 200 includes an insulating plate 210 disposed between the lower coil portion 111 and the upper coil portion 121. The insulating plate 210 electrically insulates the lower coil portion 111 from the upper coil portion 121. In the present embodiment, a first coil portion is exemplified by the lower coil portion 111. A second coil portion is exemplified by the upper coil portion 121. A first insulating section is exemplified by the insulating plate 210.

The insulating plate 210 defines a lower space in which the lower coil portion 111 is disposed and an upper space in which the upper coil portion 121 is disposed. The upper space and the lower space are aligned along the coil axis CA. The lower space may be defined as a space that expands in a horizontal direction between a lower end and an upper end of the lower coil portion 111. The upper space may be defined as a space that expands in a horizontal direction between a lower end and an upper end of the upper coil portion 121. Note that these definitions of the lower space and the upper space do not limit the principle of the present embodiment in any way. In the present embodiment, a first space is exemplified by the lower space. A second space is exemplified by the upper space.

The first wire rod 110 includes a lead wire 112 that is drawn out from the lower coil portion 111. The lead wire 112 may be the same member as the wire rod that forms the lower coil portion 111. Alternatively, the lead wire 112 may be a wire rod different from the wire rod that forms the lower coil portion 111. The principle of the present embodiment is not limited to a specific structure of the first wire rod 110.

The lead wire 112 is bent upward and passes through the upper space. In the present embodiment, a first lead wire portion is exemplified by the lead wire 112.

FIG. 1 illustrates a minimum creepage distance MCD between the lower coil portion 111 and the upper coil portion 121 and a spatial distance CL defined between the lead wire 112 and the upper coil portion 121 in the upper space. The creepage distance MCD is defined by the insulating plate 210, the lower coil portion 111, and the upper coil portion 121. The insulating structure 200 fixes the lead wire 112 so that the lead wire 112 is away from the upper coil portion 121 by the creepage distance MCD or longer. Therefore, the relationship expressed by the following formula is established between the creepage distance MCD and the spatial distance CL.

$$MCD \leq CL$$

Since the insulating structure 200 fixes the lead wire 112 under the relationship expressed by the above inequality, the coil structure 100 can have a sufficient and safe insulating property.

Second Embodiment

A designer can design various coil structures on the basis of the design principle described in association with First Embodiment. For example, the designer may give the function of the insulating structure described in association with First Embodiment to a bobbin used for formation of a coil. In Second Embodiment, a coil structure having a bobbin that functions as an insulating structure is described.

Figure 2:
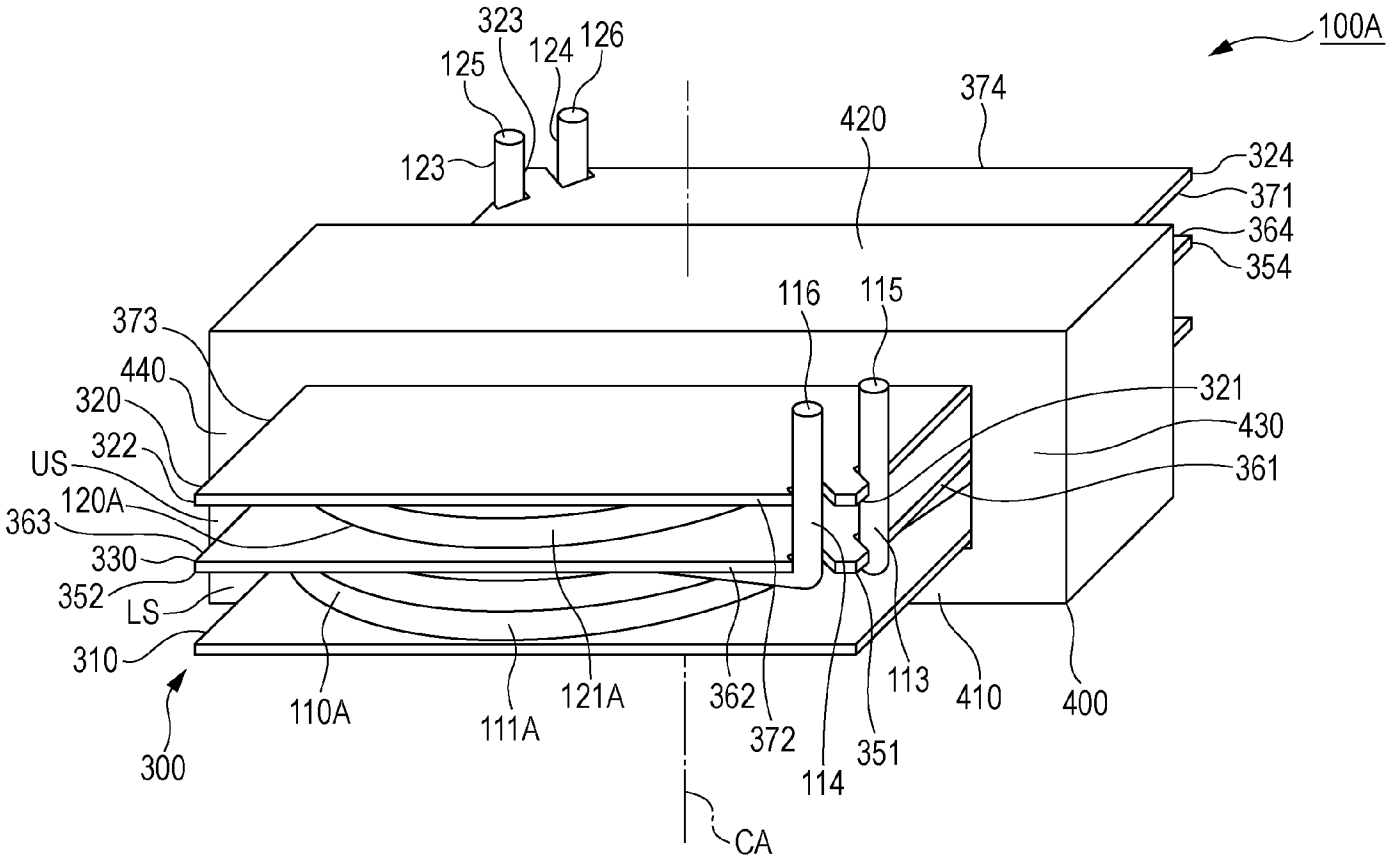
FIG. 2 is a perspective view schematically illustrating a coil structure of Second Embodiment.

FIG. 2 is a perspective view schematically illustrating a coil structure 100A of Second Embodiment. The coil structure 100A is described below with reference to FIGS. 1 and 2.

The coil structure 100A includes a first wire rod 110A, a second wire rod 120A, a bobbin 300, and a magnetic core 400. The first wire rod 110A corresponds to the first wire rod 110 described with reference to FIG. 1. The second wire rod 120A corresponds to the second wire rod 120 described with reference to FIG. 1. The bobbin 300 corresponds to the insulating structure 200 described with reference to FIG. 1.

The bobbin 300 includes a lower flange 310, an upper flange 320, and a middle flange 330. Each of the lower flange 310, the upper flange 320, and the middle flange 330 is a plate member that has a substantially square shape. Note that a designer may design the lower flange 310, the upper flange 320, and the middle flange 330 in other shapes (e.g., a triangle, an ellipse, or a pentagon). The designer may design the shapes of the lower flange 310, the upper flange 320, and the middle flange 330 in conformity with various design conditions requested for the coil structure 100A. Therefore, the principle of the present embodiment is not limited to specific shapes of the lower flange 310, the upper flange 320, and the middle flange 330.

The lower flange 310, the middle flange 330, and the upper flange 320 are aligned along the coil axis CA. The upper flange 320 is disposed above the lower flange 310. The middle flange 330 is disposed between the lower flange 310 and the upper flange 320. Accordingly, the middle flange 330 divides a space between the lower flange 310 and the upper flange 320 into a lower space LS and an upper space US. The lower space LS corresponds to the lower space described with reference to FIG. 1. The upper space US corresponds to the upper space described with reference to FIG. 1. The middle flange 330 corresponds to the insulating plate 210 described with reference to FIG. 1.

The first wire rod 110A forms a lower coil portion 111A that winds around a coil axis CA in the lower space LS. The second wire rod 120A forms an upper coil portion 121A that winds around the coil axis CA in the upper space US. The lower coil portion 111A is insulated from the upper coil portion 121A by the middle flange 330. The lower flange 310 that faces the middle flange 330 insulates the lower coil portion 111A from the magnetic core 400. The upper flange 320 that faces the middle flange 330 insulates the upper coil portion 121A from the magnetic core 400. The lower coil portion 111A corresponds to the lower coil portion 111 described with reference to FIG. 1. The upper coil portion 121A corresponds to the upper coil portion 121 described with reference to FIG. 1. In the present embodiment, a second insulating section is exemplified by the upper flange 320.

The first wire rod 110A includes two lead wires 113 and 114 drawn out from the lower coil portion 111A. The lead wire 113 includes an end 115 of the first wire rod 110A. The lead wire 114 forms an end 116 of the first wire rod 110A that is opposite to the end 115. The lead wires 113 and 114 extend from the lower space LS and pass through the upper space US. The ends 115 and 116 are located above the upper flange 320. One of the lead wires 113 and 114 corresponds to the lead wire 112 described with reference to FIG. 1. In the present embodiment, a second lead wire portion is exemplified by the other one of the lead wires 113 and 114.

The second wire rod 120A includes two lead wires 123 and 124 drawn out from the upper coil portion 121A. The lead wire 123 includes an end 125 of the second wire rod 120A. The lead wire 124 forms an end 126 of the second wire rod 120A that is opposite to the end 125. The lead wires 123 and 124 extend from the upper space US to an area above the upper flange 320. The ends 125 and 126 are located above the upper flange 320. Both of the lead wires 123 and 124 of the second wire rod 120A extend upward in the same way as the lead wires 113 and 114 of the first wire rod 110A. In the present embodiment, a third lead wire portion is exemplified by the lead wires 123 and 124.

A designer may dispose a circuit board (not illustrated) above the magnetic core 400. Since all of the ends 115, 116, 125, and 126 are disposed above the upper flange 320, the designer can simplify wiring design between the first wire rod 110A and the circuit board and between the second wire rod 120A and the circuit board.

The magnetic core 400 is a rectangular frame that surrounds the lower coil portion 111A and the upper coil portion 121A. The bobbin 300 is disposed in the magnetic core 400. The magnetic core 400 defines a magnetic path that winds around the lower coil portion 111A and the upper coil portion 121A. The designer may design the shape of the magnetic core 400 in conformity with various design conditions requested for the coil structure 100A. Therefore, the principle of the present embodiment is not limited to a specific shape of the magnetic core 400.

Figure 3:
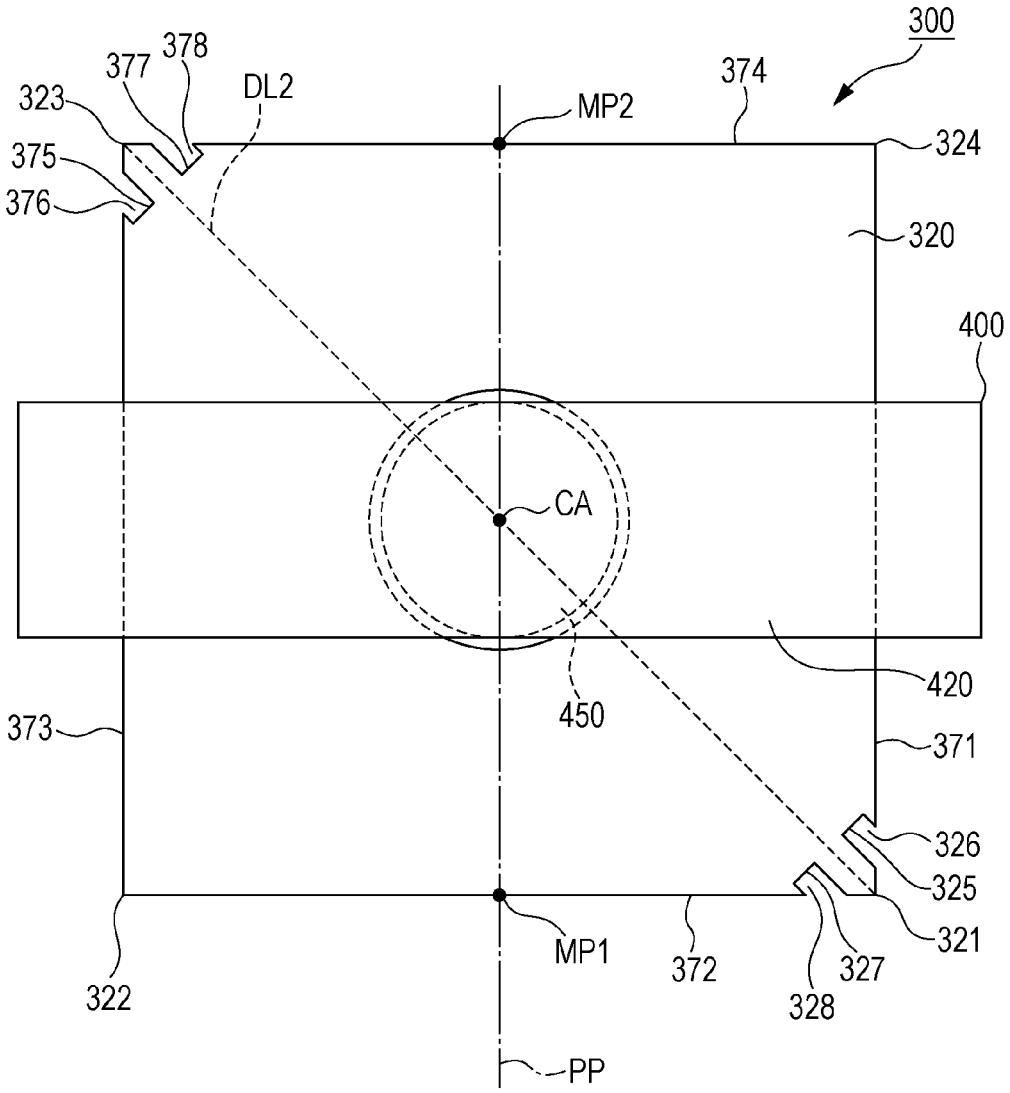
FIG. 3 is a plan view schematically illustrating a bobbin of the coil structure illustrated in FIG. 2.

FIG. 3 is a plan view schematically illustrating the bobbin 300. The bobbin 300 is described with reference to FIGS. 2 and 3.

The upper flange 320 includes a first corner portion 321, a second corner portion 322, a third corner portion 323, and a fourth corner portion 324. The coil axis CA is formed on an intersection defined by a diagonal connecting the first corner portion 321 and the third corner portion 323 and a diagonal connecting the second corner portion 322 and the fourth corner portion 324. The designer may design the position of the coil axis CA in conformity with various design conditions requested for the coil structure 100A. Therefore, the principle of the present embodiment is not limited to a specific position of the coil axis CA.

FIG. 3 illustrates a midpoint MP1 defined between the first corner portion 321 and the second corner portion 322 and a midpoint MP2 defined between the third corner portion 323 and the fourth corner portion 324. FIG. 3 further illustrates a plane PP that passes through the midpoints MP1 and MP2. The plane PP is substantially orthogonal to the magnetic path defined on the upper flange 320 by the upper flange 320 and the magnetic core 400.

Figure 4A:
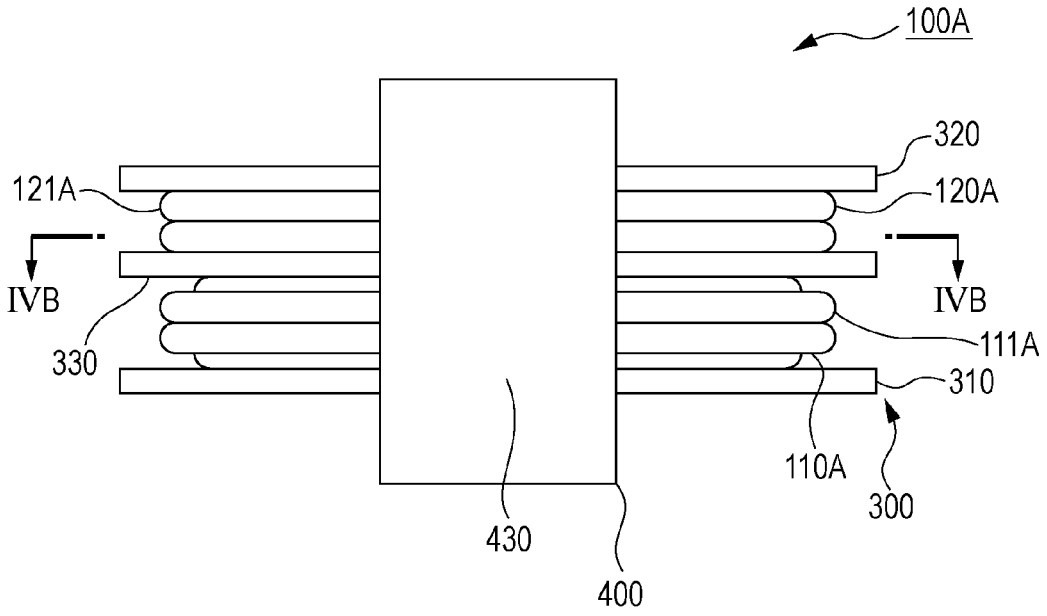
FIG. 4A is a side view schematically illustrating a coil structure illustrated in FIG. 2.
Figure 4B:
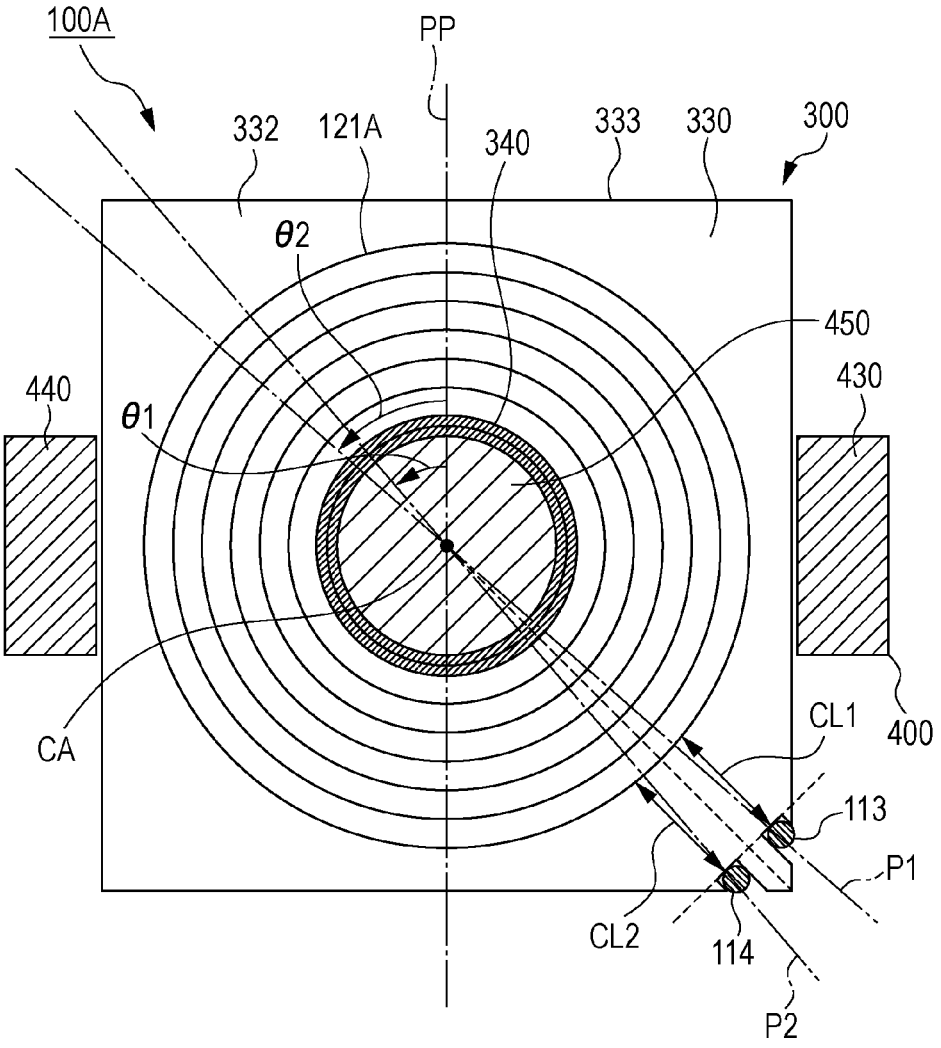
FIG. 4B is a cross-sectional view schematically illustrating the coil structure taken along the line IVB-IVB illustrated in FIG. 4A.

FIG. 4A is a side view schematically illustrating the coil structure 100A. FIG. 4B is a cross-sectional view schematically illustrating the coil structure 100A taken along the line IVB-IVB in FIG. 4A. The coil structure 100A is described with reference to FIGS. 1 through 4B.

The magnetic core 400 includes a lower magnetic portion 410, an upper magnetic portion 420, a right magnetic leg 430, a left magnetic leg 440, and a core leg 450. The lower magnetic portion 410 extends below the lower flange 310. The upper magnetic portion 420 extends above the upper flange 320. The right magnetic leg 430 extends on the right side of the bobbin 300 from the lower magnetic portion 410 to the upper magnetic portion 420. The left magnetic leg 440 extends on the left side of the bobbin 300 from the lower magnetic portion 410 to the upper magnetic portion 420. The core leg 450 penetrates the bobbin 300 and extends from the lower magnetic portion 410 to the upper magnetic portion 420.

The bobbin 300 includes a cylindrical portion 340 to which the lower flange 310, the upper flange 320, and the middle flange 330 are connected. The central axis of the cylindrical portion 340 substantially coincides with the coil axis CA. The first wire rod 110A and the second wire rod 120A are wound around the cylindrical portion 340. Accordingly, the lower coil portion 111A and the upper coil portion 121A have a substantially cylindrical shape.

Since the middle flange 330 has a substantially square shape, the center of gravity of the middle flange 330 substantially coincides with the coil axis CA. In addition, the center of the lower coil portion 111A and the center of the upper coil portion 121A also substantially coincide with the coil axis CA. Therefore, a creepage distance between the lower coil portion 111A and the upper coil portion 121A is minimum on the plane PP described with reference to FIG. 3 (that is, the minimum creepage distance MCD described with reference to FIG. 1 is obtained).

Figure 5:
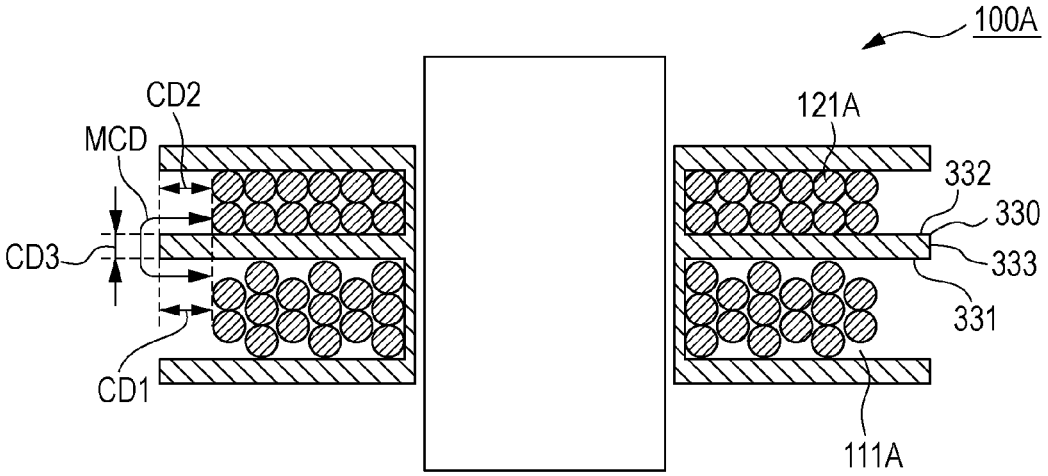
FIG. 5 is a cross-sectional view schematically illustrating the coil structure illustrated in FIG. 2.

FIG. 5 is a cross-sectional view schematically illustrating the coil structure 100A taken along the plane PP described with reference to FIG. 3. The coil structure 100A is described with reference to FIGS. 3, 4B, and 5.

The middle flange 330 includes a lower surface 331, an upper surface 332, and an edge surface 333. The lower surface 331 faces the lower coil portion 111A. The upper surface 332 faces the upper coil portion 121A. The edge surface 333 defines outer contours of the lower surface 331 and the upper surface 332 (i.e., square contours). In the present embodiment, a first surface is exemplified by the lower surface 331. A second surface is exemplified by the upper surface 332.

FIG. 5 illustrates a first creepage distance CD1 defined between the outermost edge of the lower coil portion 111A and the edge surface 333, a second creepage distance CD2 defined between the outermost edge of the upper coil portion 121A and the edge surface 333, and a third creepage distance CD3 defined on the edge surface 333 from the lower surface 331 to the upper surface 332. The creepage distance MCD may be defined as the sum of the first creepage distance CD1, the second creepage distance CD2, and the third creepage distance CD3. That is, the creepage distance MCD may be defined by the following formula.

$$MCD=CD1+CD2+CD3$$

In the present embodiment, the sum of the first creepage distance CD1, the second creepage distance CD2, and the third creepage distance CD3 is minimum on the plane PP as described above. Therefore, a first plane is exemplified by the plane PP.

The designer may determine the first plane by using the above formula. The designer may set a virtual plane containing the coil axis CA and rotate the virtual plane about the coil axis CA. The designer may set, as the first plane, a virtual plane at such a rotational position that the sum of the first creepage distance CD1, the second creepage distance CD2, and the third creepage distance CD3 is minimum. The technique of setting the first plane utilizing rotation of the virtual plane is applicable to coil structures of various shapes.

FIG. 4B illustrates planes P1 and P2 in addition to the plane PP described with reference to FIG. 3. The plane P1 is set at a position rotated from the plane PP by an angle θ2 (θ2>0°) in a counterclockwise direction. The plane P2 is set at a position rotated from the plane PP by an angle θ1 (θ2>θ1>0°) in a counterclockwise direction. The lead wire 113 is fixed on the plane P1. The lead wire 114 is fixed on the plane P2.

FIG. 4B illustrates a spatial distance CL1 between the lead wire 113 and the upper coil portion 121A and a spatial distance CL2 between the lead wire 114 and the upper coil portion 121A. The designer sets positions where the lead wires 113 and 114 are fixed so that the relationship expressed by the following formula is satisfied.

$$CL1 \geq MCD$$

$$CL2 \geq MCD$$

Since the lead wires 113 and 114 are fixed on the planes P1 and P2 that are different from the plane PP, the designer can easily set the fixation positions that satisfy the relationship expressed by the above formula.

Figure 6:
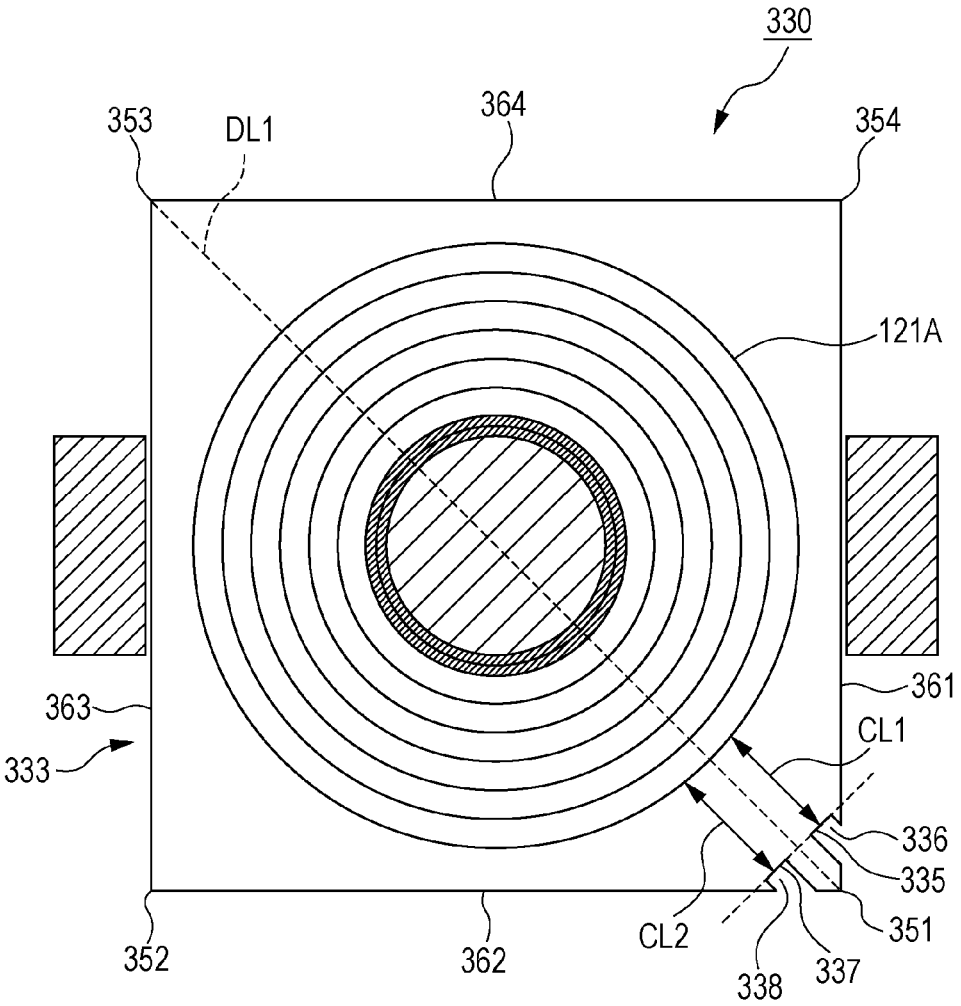
FIG. 6 is a plan view schematically illustrating a middle flange of the bobbin illustrated in FIG. 3.

FIG. 6 is a plan view schematically illustrating the middle flange 330. The coil structure 100A is further described with reference to FIGS. 2, 3, and 6.

The middle flange 330 includes a first corner portion 351, a second corner portion 352, a third corner portion 353, and a fourth corner portion 354. The first corner portion 351 is located below the first corner portion 321 of the upper flange 320. The second corner portion 352 is located below the second corner portion 322 of the upper flange 320. The third corner portion 353 is located below the third corner portion 323 of the upper flange 320. The fourth corner portion 354 is located below the fourth corner portion 324 of the upper flange 320.

The edge surface 333 includes a right edge 361, a front edge 362, a left edge 363, and a rear edge 364. The right edge 361 extends between the first corner portion 351 and the fourth corner portion 354. The front edge 362 extends between the first corner portion 351 and the second corner portion 352. The left edge 363 extends between the second corner portion 352 and the third corner portion 353. The rear edge 364 extends between the third corner portion 353 and the fourth corner portion 354.

The right edge 361 includes a substantially C-shaped cutout edge 335 for fixing the lead wire 113. The cutout edge 335 defines a cutout portion 336 that is recessed in the edge surface 333. The lead wire 113 is inserted into the cutout portion 336. The front edge 362 includes a substantially C-shaped cutout edge 337 for fixing the lead wire 114. The cutout edge 337 defines a cutout portion 338 that is recessed in the edge surface 333. The lead wire 114 is inserted into the cutout portion 338.

FIG. 6 illustrates a diagonal DL1 that connects the first corner portion 351 and the third corner portion 353. The cutout portions 336 and 338 extend substantially parallel with the diagonal DL1. Note that the principle of the present embodiment is not limited to specific shapes of the cutout portions 336 and 338.

The spatial distance CL1 between the lead wire 113 and the upper coil portion 121A may be defined as the shortest distance between the cutout edge 335 and the upper coil portion 121A. The spatial distance CL2 between the lead wire 114 and the upper coil portion 121A may be defined as the shortest distance between the cutout edge 337 and the upper coil portion 121A. Note that these definitions of the spatial distances CL1 and CL2 do not limit the principle of the present embodiment in any way.

The designer may determine depth dimensions of the cutout portions 336 and 338 so that the relationship expressed by the above formula is satisfied. In the present embodiment, a first fixing edge is exemplified by one of the right edge 361 and the front edge 362. A second fixing edge is exemplified by the other one of the right edge 361 and the front edge 362.

The upper flange 320 includes a right edge 371, a front edge 372, a left edge 373, and a rear edge 374. The right edge 371 extends between the first corner portion 321 and the fourth corner portion 324. The front edge 372 extends between the first corner portion 321 and the second corner portion 322. The left edge 373 extends between the second corner portion 322 and the third corner portion 323. The rear edge 374 extends between the third corner portion 323 and the fourth corner portion 324.

The right edge 371 includes a substantially C-shaped cutout edge 325 for fixing the lead wire 113. The cutout edge 325 defines a cutout portion 326. The cutout portion 326 is formed substantially directly above the cutout portion 336 formed in the middle flange 330. The cutout portion 326 has substantially identical shape and size to those of the cutout portion 336 formed in the middle flange 330. The lead wire 113 is inserted into the cutout portion 326. The front edge 372 includes a substantially C-shaped cutout edge 327 for fixing the lead wire 114. The cutout edge 327 defines a cutout portion 328. The cutout portion 328 is formed substantially directly above the cutout portion 338 formed in the middle flange 330. The cutout portion 328 may have substantially identical shape and size to those of the cutout portion 338 formed in the middle flange 330. The lead wire 114 is inserted into the cutout portion 328.

FIG. 3 illustrates a diagonal DL2 that connects the first corner portion 351 and the third corner portion 353. The cutout portions 326 and 328 extend substantially parallel with the diagonal DL2. Note that the principle of the present embodiment is not limited to specific shapes of the cutout portions 326 and 328.

The left edge 373 includes a substantially C-shaped cutout edge 375 for fixing the lead wire 123. The cutout edge 375 defines a cutout portion 376. The lead wire 123 is inserted into the cutout portion 376. The rear edge 374 includes a substantially C-shaped cutout edge 377 for fixing the lead wire 124. The cutout edge 377 defines a cutout portion 378. The lead wire 124 is inserted into the cutout portion 378. The cutout portions 376 and 378 extend substantially parallel with the diagonal DL2. The cutout portions 376 and 378 may have substantially identical shape and size to those of the cutout portions 326 and 328. Note that the principle of the present embodiment is not limited to specific shapes of the cutout portions 376 and 378.

Third Embodiment

The two lead wires of the first wire rod described in association with Second Embodiment are drawn out in parallel with each other. If the two lead wires sterically cross each other in the lower space, a leakage magnetic flux from the lower coil portion is small. Similarly, if the two lead wires of the second lead wire sterically cross each other in the upper space, a leakage magnetic flux from the upper coil portion is small. In Third Embodiment, a technique for reducing the leakage magnetic flux is described.

Figure 7:
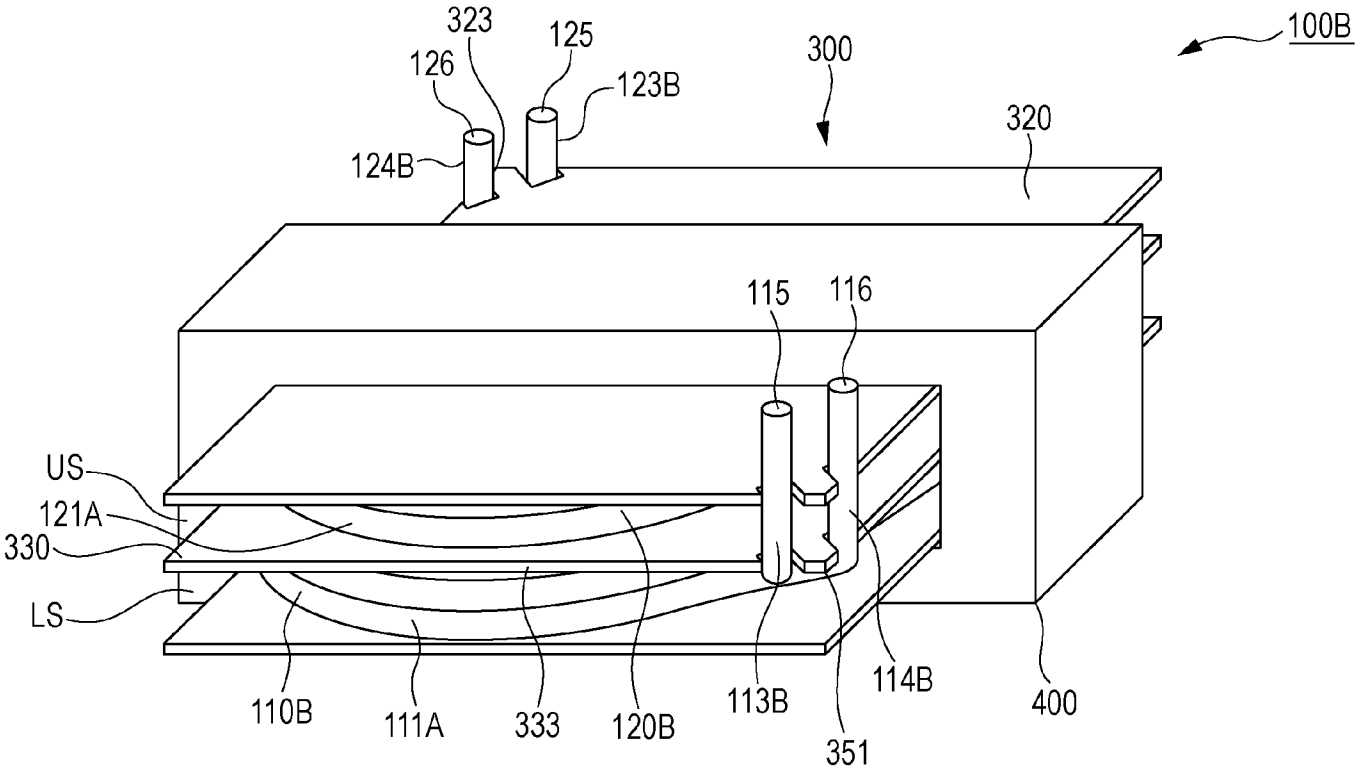
FIG. 7 is a perspective view schematically illustrating a coil structure of Third Embodiment.

FIG. 7 is a perspective view schematically illustrating a coil structure 100B of Third Embodiment. The coil structure 100B is described with reference to FIGS. 1 and 7. Reference signs common to both Second Embodiment and Third Embodiment mean that elements given these reference signs have identical functions to those of Second Embodiment. Therefore, the description in Second Embodiment is incorporated in these elements.

As in Second Embodiment, the coil structure 100B includes a bobbin 300 and a magnetic core 400. The coil structure 100B further includes a first wire rod 110B and a second wire rod 120B.

As in Second Embodiment, the first wire rod 110B forms a lower coil portion 111A in a lower space LS. The second wire rod 120B forms an upper coil portion 121A in an upper space US.

The first wire rod 110B includes two lead wires 113B and 114B drawn out from the lower coil portion 111A. As in Second Embodiment, the lead wire 113B includes an end 115. The lead wire 114B includes an end 116.

The lead wires 113B and 114B extend from the lower space LS and pass through the upper space US. The ends 115 and 116 are located above an upper flange 320. One of the lead wires 113B and 114B corresponds to the lead wire 112 described with reference to FIG. 1. In the present embodiment, a second lead wire portion is exemplified by the other one of the lead wires 113B and 114B.

The second wire rod 120B includes two lead wires 123B and 124B drawn out from the upper coil portion 121A. As in Second Embodiment, the lead wire 123B includes an end 125. The lead wire 124B includes an end 126.

The lead wires 123B and 124B extend from the upper space US to an area above the upper flange 320. The ends 125 and 126 are located above the upper flange 320. Both of the lead wires 123B and 124B of the second wire rod 120B extend upward in the same manner as the lead wires 113B and 114B of the first wire rod 110B. In the present embodiment, a third lead wire portion is exemplified by one of the lead wires 123B and 124B.

A designer may dispose a circuit board (not illustrated) above the magnetic core 400. Since all of the ends 115, 116, 125, and 126 are disposed above the upper flange 320, the designer can simplify wiring design between the first wire rod 110B and the circuit board and between the second wire rod 120B and the circuit board.

Figure 8:
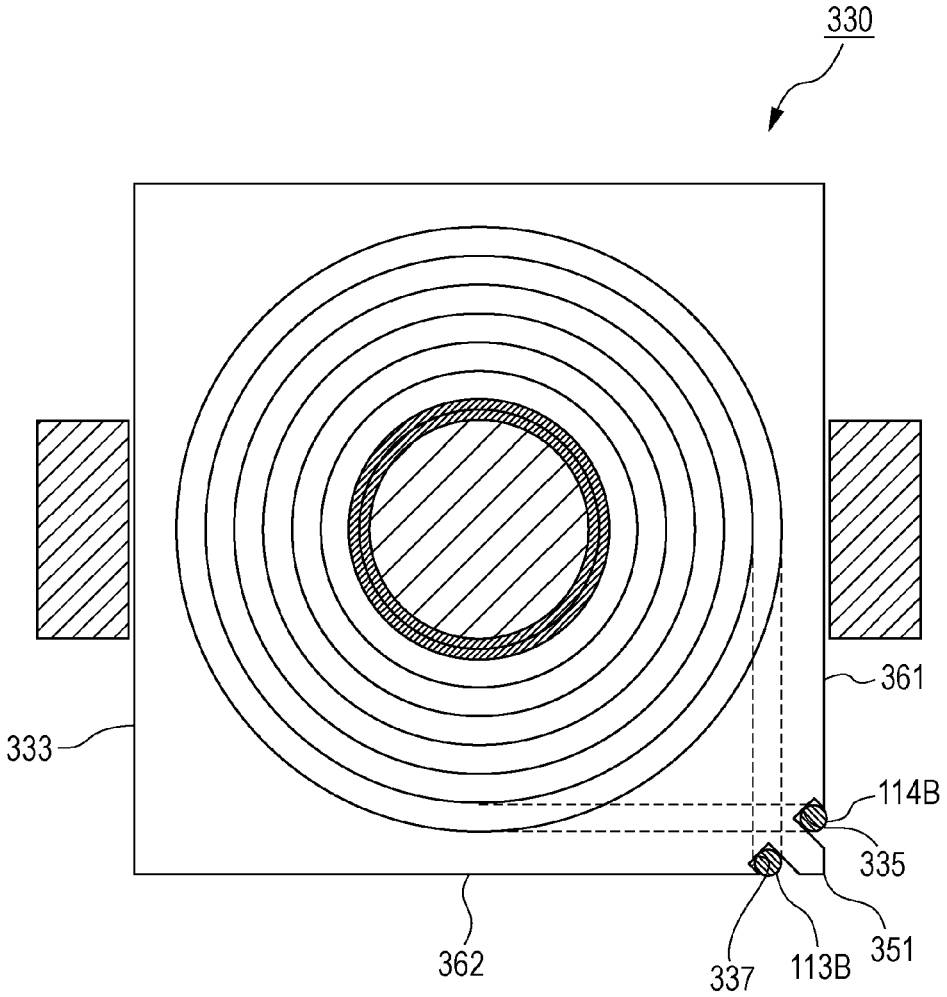
FIG. 8 is a plan view schematically illustrating a middle flange of the coil structure illustrated in FIG. 7.

FIG. 8 is a plan view schematically illustrating a middle flange 330. The coil structure 100B is further described with reference to FIGS. 7 and 8.

As described in association with Second Embodiment, a right edge 361 forms a first corner portion 351 on an edge surface 333 in cooperation with a front edge 362. A cutout edge 335 sandwiches the lead wire 114B in the vicinity of the first corner portion 351. A cutout edge 337 sandwiches the lead wire 113B in the vicinity of the first corner portion 351. The lead wire 114B extending from the lower coil portion 111A to the cutout edge 335 sterically crosses, in the lower space LS, the lead wire 113B extending from the lower coil portion 111A to the cutout edge 337. As a result, a leakage magnetic flux in the lower space LS becomes small.

Figure 9:
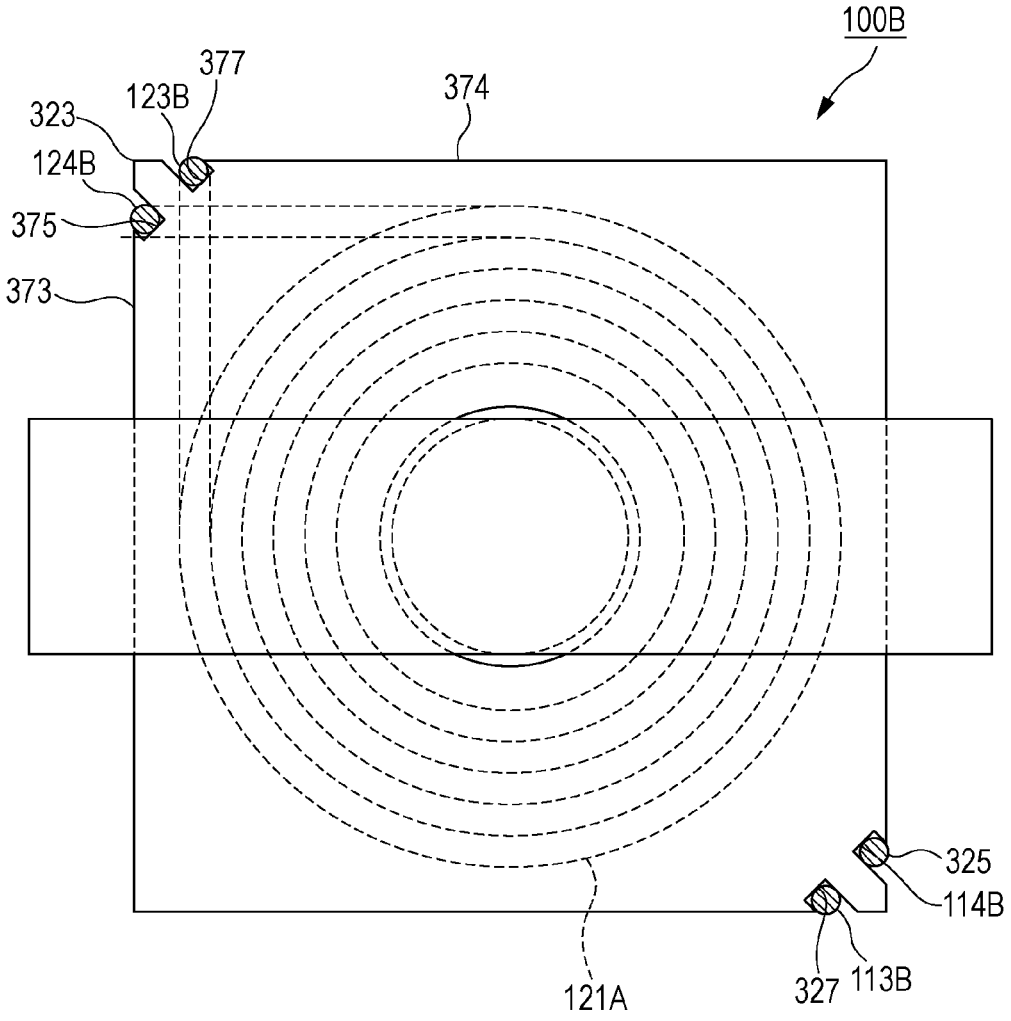
FIG. 9 is a plan view schematically illustrating the coil structure illustrated in FIG. 7.

FIG. 9 is a plan view schematically illustrating the coil structure 100B. The coil structure 100B is further described with reference to FIGS. 7 and 9.

The lead wire 114B extends upward from the middle flange 330 and is sandwiched by a cutout edge 325. The lead wire 113B extends upward from the middle flange 330 and is sandwiched by a cutout edge 327.

As described in association with Second Embodiment, a left edge 373 forms a third corner portion 323 in association with a rear edge 374. A cutout edge 375 sandwiches the lead wire 124B in the vicinity of the third corner portion 323. A cutout edge 377 sandwiches the lead wire 123B in the vicinity of the third corner portion 323. The lead wire 124B extending from the upper coil portion 121A to the cutout edge 375 sterically crosses, in the upper space US, the lead wire 123B extending from the upper coil portion 121A to the cutout edge 377. As a result, a leakage magnetic flux in the upper space US becomes small.

Fourth Embodiment

Unlike Third Embodiment, if one lead wire is away from a coil portion in a direction in which one lead wire is away from the other lead wire, a leakage magnetic flux is large. In Fourth Embodiment, a coil structure in which a large leakage magnetic flux can occur is described.

Figure 10:
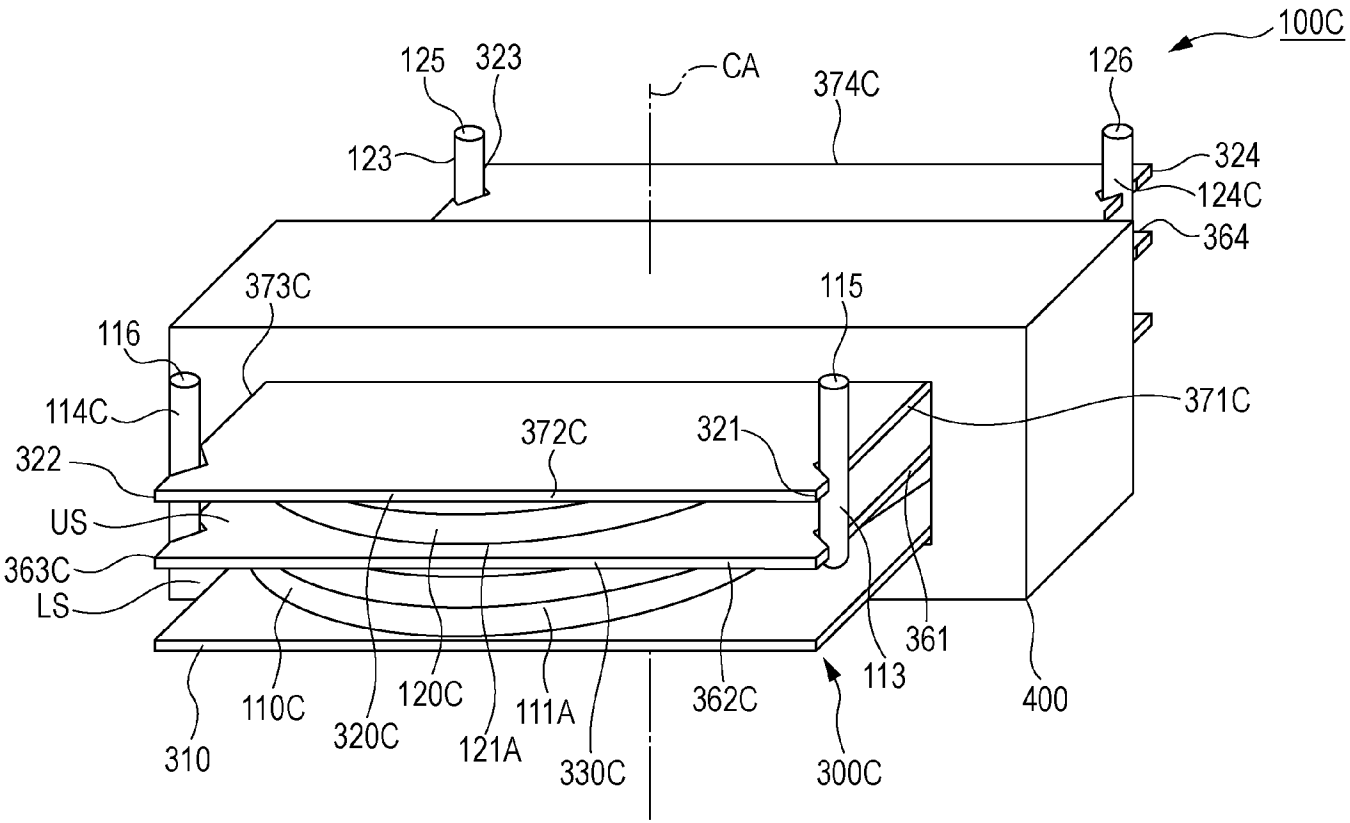
FIG. 10 is a perspective view schematically illustrating a coil structure of Fourth Embodiment.

FIG. 10 is a perspective view schematically illustrating a coil structure 100C of Fourth Embodiment. The coil structure 100C is described with reference to FIGS. 1 and 10. Reference signs common to both Second Embodiment and Fourth Embodiment mean that elements given these reference signs have identical functions to those of Second Embodiment. Therefore, the description in Second Embodiment is incorporated in these elements.

As in Second Embodiment, the coil structure 100C includes a magnetic core 400. The coil structure 100C further includes a first wire rod 110C, a second wire rod 120C, and a bobbin 300C.

As in Second Embodiment, the bobbin 300C includes a lower flange 310. The bobbin 300C further includes an upper flange 320C and a middle flange 330C.

Each of the lower flange 310, the upper flange 320C, and the middle flange 330C is a plate member that has a substantially square shape. Note that a designer may design the lower flange 310, the upper flange 320C, and the middle flange 330C in other shapes (e.g., a triangle, an ellipse, or a pentagon). The designer may design the shapes of the lower flange 310, the upper flange 320C, and the middle flange 330C in conformity with various design conditions requested for the coil structure 100C. Therefore, the principle of the present embodiment is not limited to specific shapes of the lower flange 310, the upper flange 320C, and the middle flange 330C.

The lower flange 310, the middle flange 330C, and the upper flange 320C are aligned along a coil axis CA. The upper flange 320C is disposed above the lower flange 310. The middle flange 330C is disposed between the lower flange 310 and the upper flange 320C.

As in Second Embodiment, the middle flange 330C divides a space between the lower flange 310 and the upper flange 320C into a lower space LS and an upper space US. The middle flange 330C corresponds to the insulating plate 210 described with reference to FIG. 1.

As in Second Embodiment, the first wire rod 110C forms a lower coil portion 111A in the lower space LS. The second wire rod 120C forms an upper coil portion 121A in the upper space US.

As in Second Embodiment, the first wire rod 110C includes a lead wire 113. The lead wire 113 includes an end 115. The first wire rod 110C further includes a lead wire 114C having an end 116 opposite to the end 115.

The lead wires 113 and 114C extend from the lower space LS and pass through the upper space US. The ends 115 and 116 are located above the upper flange 320C. One of the lead wires 113 and 114C corresponds to the lead wire 112 described with reference to FIG. 1. In the present embodiment, a second lead wire portion is exemplified by the other one of the lead wires 113 and 114C.

As in Second Embodiment, the second wire rod 120C includes two lead wires 123 and 124C drawn out from the upper coil portion 121A. The lead wire 123 includes an end 125. The lead wire 124C has an end 126 opposite to the end 115.

The lead wires 123 and 124C extend from the upper space US to an area above the upper flange 320C. The ends 125 and 126 are located above the upper flange 320C. Both of the lead wires 123 and 124C of the second wire rod 120C extend upward in the same manner as the lead wires 113 and 114C of the first wire rod 110C. In the present embodiment, a third lead wire portion is exemplified by one of the lead wires 123 and 124C.

A designer may dispose a circuit board (not illustrated) above the magnetic core 400. Since all of the ends 115, 116, 125, and 126 are disposed above the upper flange 320C, the designer can simplify wiring design between the first wire rod 110C and the circuit board and between the second wire rod 120C and the circuit board.

Figure 11:
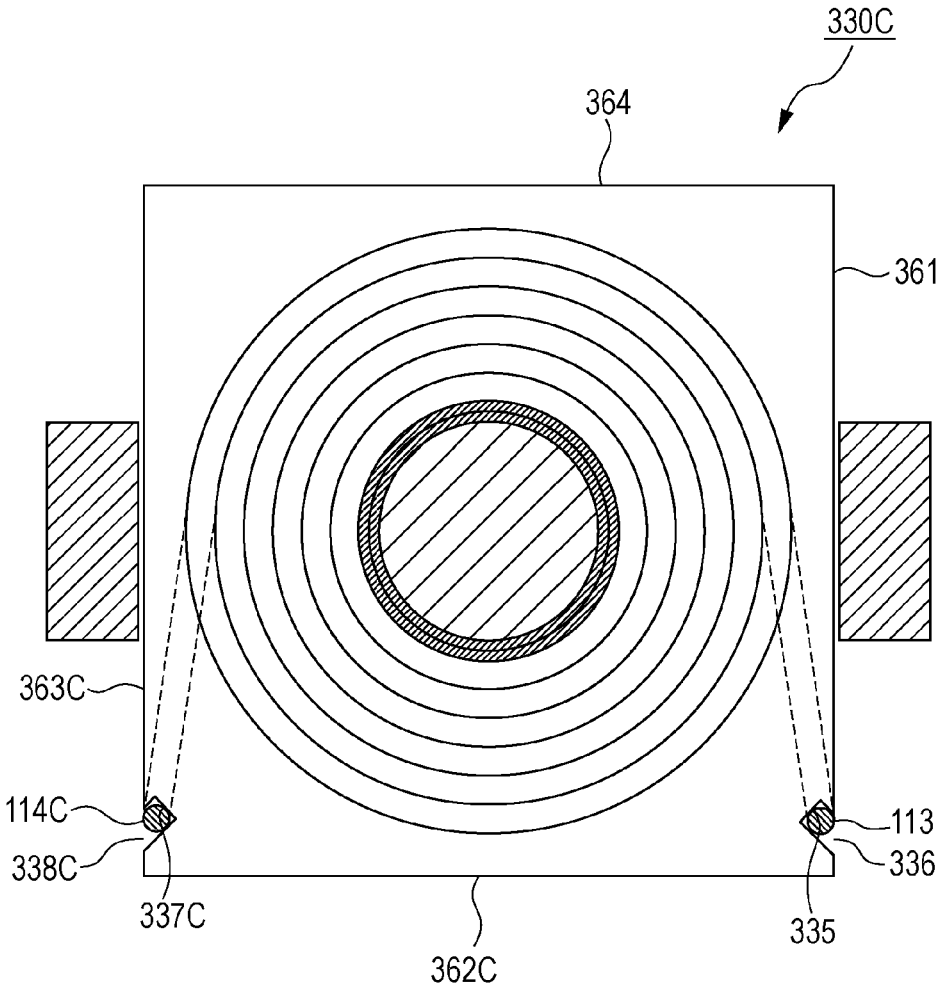
FIG. 11 is a plan view schematically illustrating a middle flange of the coil structure illustrated in FIG. 10.

FIG. 11 is a plan view schematically illustrating the middle flange 330C. The coil structure 100C is further described with reference to FIGS. 10 and 11.

As in Second Embodiment, the middle flange 330C includes a right edge 361 and a rear edge 364. The lead wire 113 is fixed by a cutout edge 335 of the right edge 361.

The middle flange 330C includes a left edge 363C opposite to the right edge 361 and a front edge 362C opposite to the rear edge 364. Unlike Second Embodiment, the front edge 362C is linear.

The left edge 363C includes a cutout edge 337C that defines a cutout portion 338C. The cutout edge 337C fixes the lead wire 114C. The design principle of the cutout portion described in association with Second Embodiment is suitably applied to the cutout portion 338C.

The lead wire 114C is drawn out from the lower coil portion 111A in a direction away from the lead wire 113. As a result, a leakage magnetic flux in the lower space LS becomes large.

Figure 12:
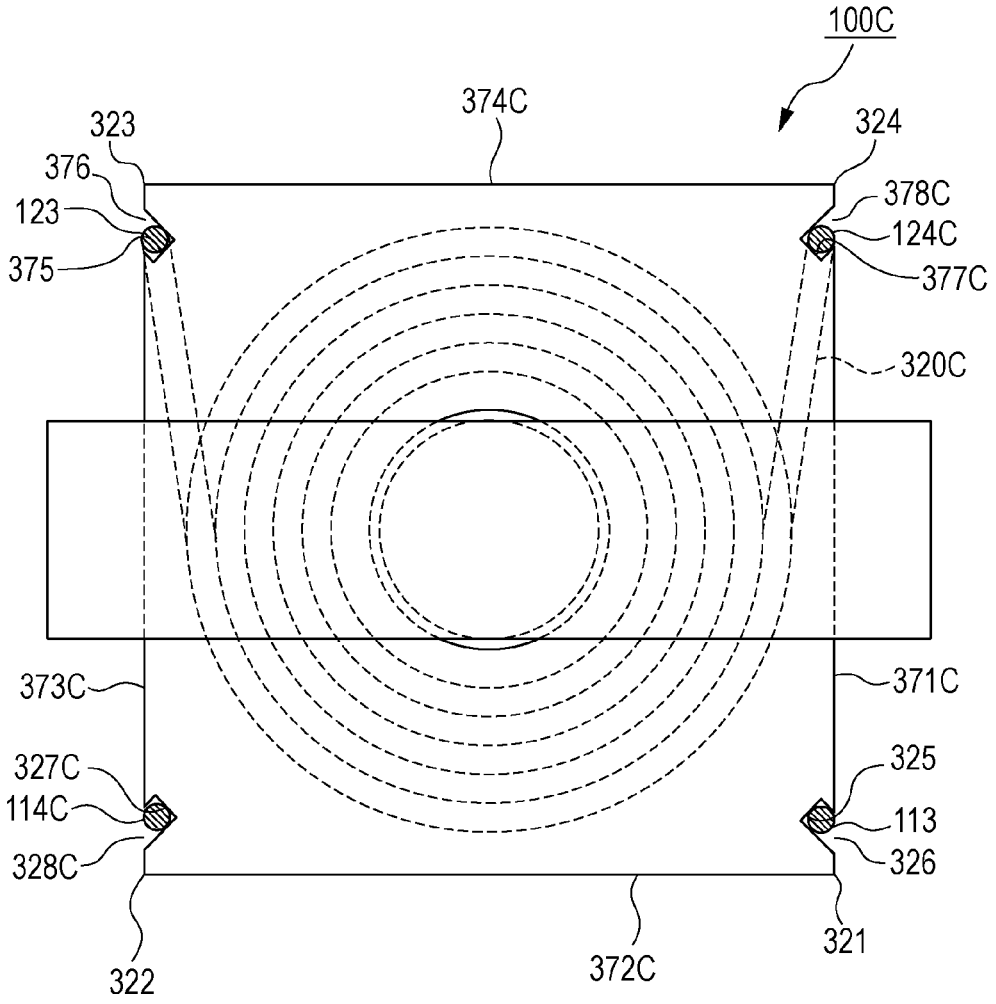
FIG. 12 is a plan view schematically illustrating the coil structure illustrated in FIG. 10.

FIG. 12 is a plan view schematically illustrating the coil structure 100C. The coil structure 100C is further described with reference to FIGS. 10 through 12.

As in Second Embodiment, the upper flange 320C includes a first corner portion 321, a second corner portion 322, a third corner portion 323, and a fourth corner portion 324. The upper flange 320C includes a right edge 371C, a front edge 372C, a left edge 373C, and a rear edge 374C. The right edge 371C forms the first corner portion 321 in cooperation with the front edge 372C. The front edge 372C forms the second corner portion 322 in cooperation with the left edge 373C. The left edge 373C forms the third corner portion 323 in cooperation with the rear edge 374C. The rear edge 374C forms the fourth corner portion 324 in cooperation with the right edge 371C.

As in Second Embodiment, the right edge 371C includes a cutout edge 325 that defines a cutout portion 326. The right edge 371C further includes a cutout edge 377C that defines a cutout portion 378C. The cutout portion 326 is formed close to the first corner portion 321, whereas the cutout portion 378C is formed close to the fourth corner portion 324.

As in Second Embodiment, the left edge 373C includes a cutout edge 375 that defines a cutout portion 376. The left edge 373C further includes a cutout edge 327C that defines a cutout portion 328C. The cutout portion 376 is formed close to the third corner portion 323, whereas the cutout portion 328C is formed close to the second corner portion 322.

The cutout portion 326 is formed substantially directly above a cutout portion 336 formed in the middle flange 330C. The cutout portion 328C is formed substantially above the cutout portion 338C formed in the middle flange 330C. The lead wire 113 extends upward from the middle flange 330C and is sandwiched by the cutout edge 325. The lead wire 114C extends upward from the middle flange 330C and is sandwiched by the cutout edge 327C.

As in Second Embodiment, the lead wire 123 is fixed by the cutout edge 375. Unlike Second Embodiment, the lead wire 124C is fixed by the cutout edge 377C that defines the cutout portion 378C opposite to the cutout portion 376. Therefore, the lead wire 124C is drawn out from the upper coil portion 121A in a direction away from the lead wire 123. As a result, a leakage magnetic flux in the upper space US becomes large.

Fifth Embodiment

In Second Embodiment through Fourth Embodiment, a lead wire is fixed by being inserted into a cutout portion formed in a bobbin. Alternatively, the lead wire may be fixed by being inserted into a through-hole formed in a bobbin. In Fifth Embodiment, a technique of fixing a lead wire by using a through-hole is described.

Figure 13:
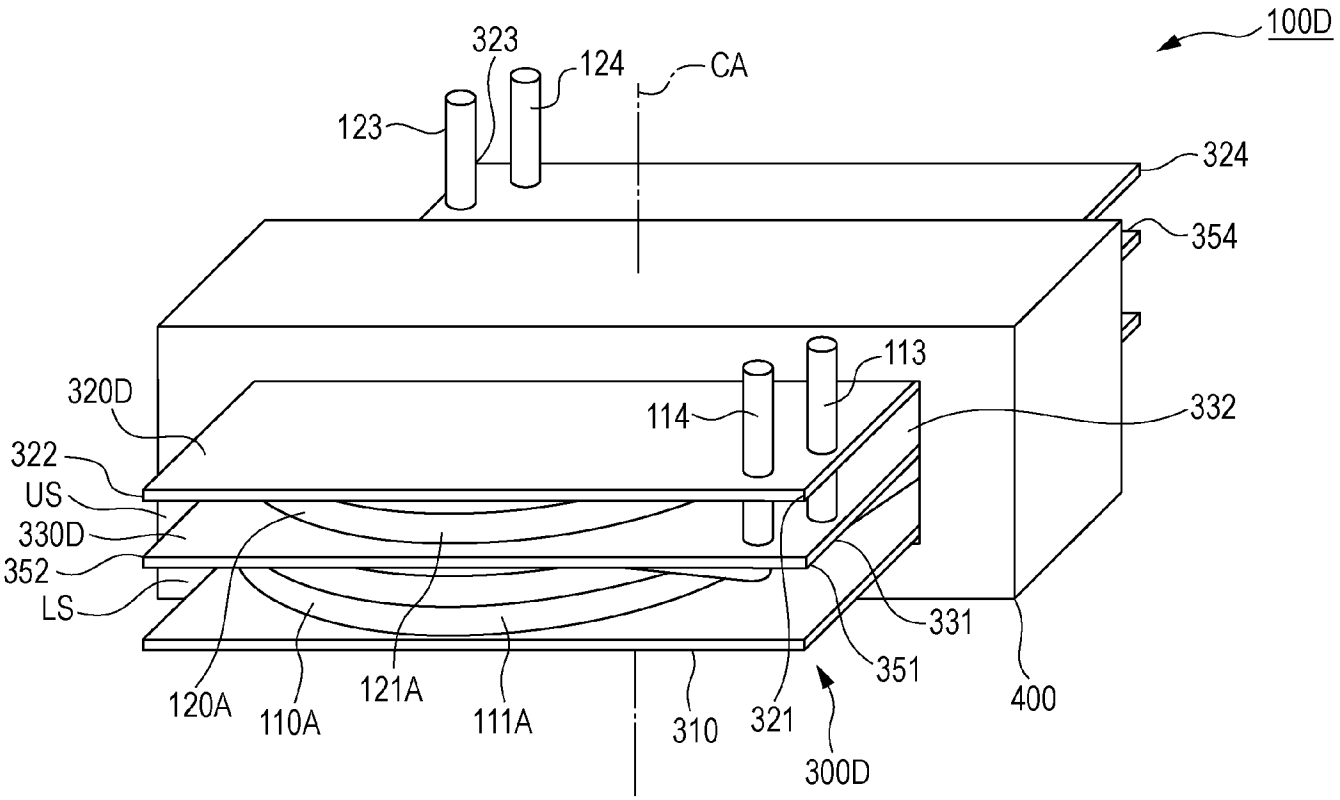
FIG. 13 is a perspective view schematically illustrating a coil structure of Fifth Embodiment.

FIG. 13 is a perspective view schematically illustrating a coil structure 100D of Fifth Embodiment. The coil structure 100D is described with reference to FIGS. 1 and 13. Reference signs common to both Second Embodiment and Fifth Embodiment mean that elements given these reference signs have identical functions to those of Second Embodiment. Therefore, the description in Second Embodiment is incorporated in these elements.

As in Second Embodiment, the coil structure 100D includes a first wire rod 110A, a second wire rod 120A, and a magnetic core 400. The coil structure 100D further includes a bobbin 300D.

As in Second Embodiment, the bobbin 300D includes a lower flange 310. The bobbin 300D further includes an upper flange 320D and a middle flange 330D.

Each of the lower flange 310, the upper flange 320D, and the middle flange 330D is a plate member that has a substantially square shape. Note that a designer may design the lower flange 310, the upper flange 320D, and the middle flange 330D in other shapes (e.g., a triangle, an ellipse, or a pentagon). The designer may design the shapes of the lower flange 310, the upper flange 320D, and the middle flange 330D in conformity with various design conditions requested for the coil structure 100D. Therefore, the principle of the present embodiment is not limited to specific shapes of the lower flange 310, the upper flange 320D, and the middle flange 330D.

The lower flange 310, the middle flange 330D, and the upper flange 320D are aligned along a coil axis CA. The upper flange 320D is disposed above the lower flange 310. The middle flange 330D is disposed between the lower flange 310 and the upper flange 320D.

As in Second Embodiment, the middle flange 330D divides a space between the lower flange 310 and the upper flange 320D into a lower space LS and an upper space US. The middle flange 330D corresponds to the insulating plate 210 described with reference to FIG. 1.

Figure 14:
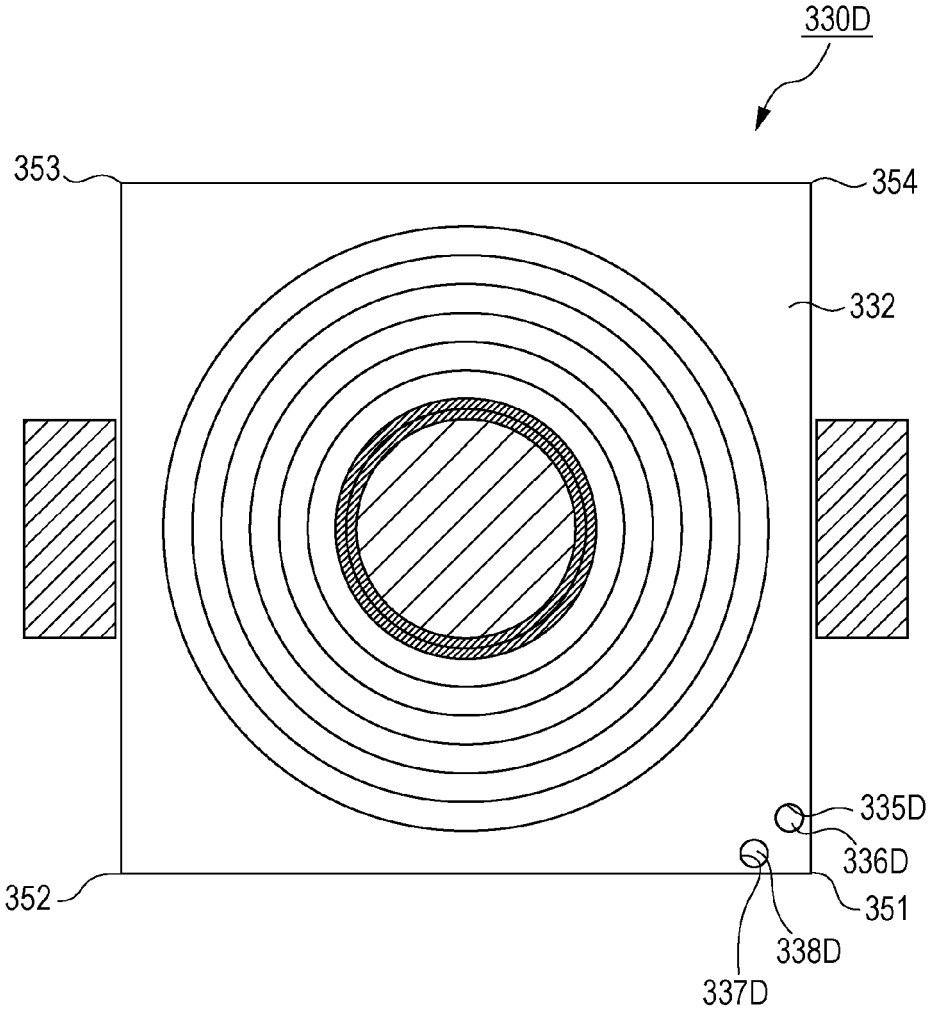
FIG. 14 is a plan view schematically illustrating a middle flange of the coil structure illustrated in FIG. 13.

FIG. 14 is a plan view schematically illustrating the middle flange 330D. The coil structure 100D is further described with reference to FIGS. 13 and 14.

As in Second Embodiment, the middle flange 330D includes a lower surface 331, an upper surface 332, a first corner portion 351, a second corner portion 352, a third corner portion 353, and a fourth corner portion 354. The middle flange 330D further includes hole edges 335D and 337D. The hole edge 335D defines a through-hole 336D that passes from the lower surface 331 to the upper surface 332 in the vicinity of the first corner portion 351. The hole edge 337D defines a through-hole 338D that passes from the lower surface 331 to the upper surface 332 in the vicinity of the first corner portion 351. The positions of the through-holes 336D and 338D may be determined on the basis of the design principle of a cutout portion described in association with Second Embodiment. In the present embodiment, a first fixing edge is exemplified by one of the hole edges 335D and 337D.

A lead wire 113 drawn out from the lower coil portion 111A is inserted from the lower space LS into the through-hole 336D. A lead wire 114 drawn out from the lower coil portion 111A is inserted from the lower space LS into the through-hole 338D.

Figure 15:
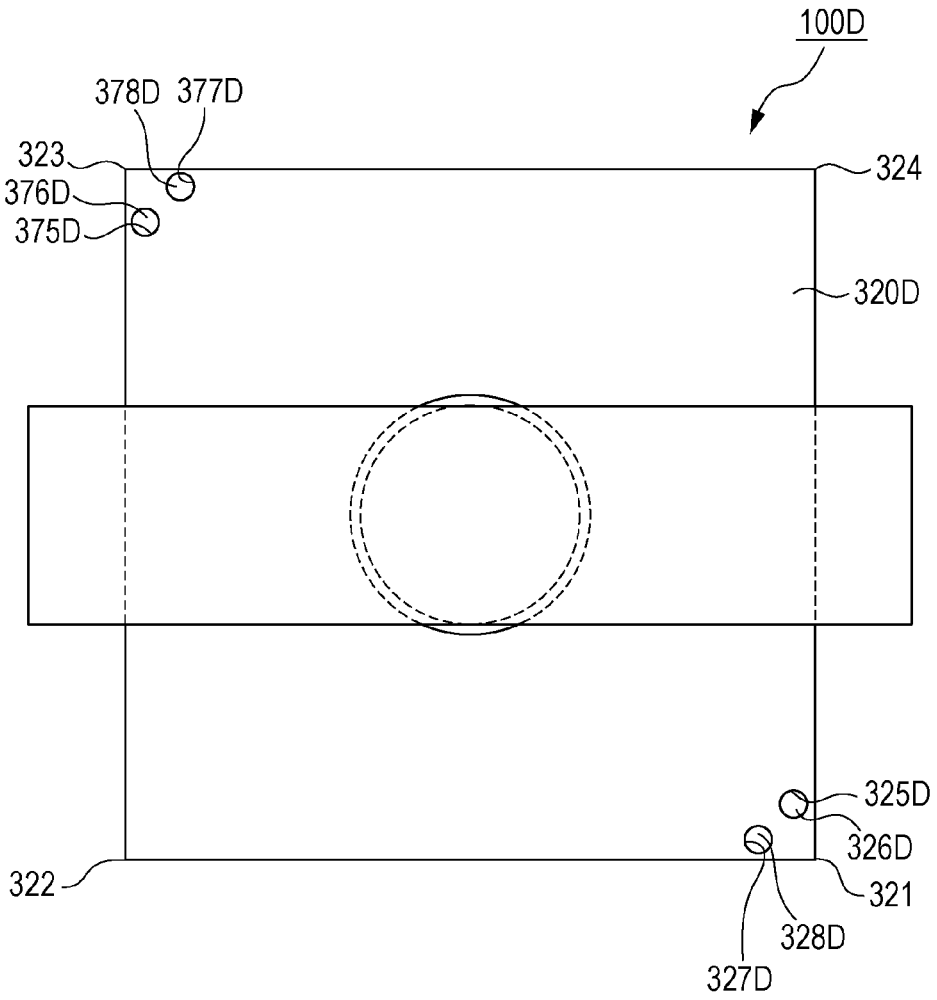
FIG. 15 is a plan view schematically illustrating the coil structure illustrated in FIG. 13.

FIG. 15 is a plan view schematically illustrating the coil structure 100D. The coil structure 100D is further described with reference to FIGS. 13 through 15.

As in Second Embodiment, the upper flange 320D includes a first corner portion 321, a second corner portion 322, a third corner portion 323, and a fourth corner portion 324. The upper flange 320D further includes hole edges 325D and 327D. The hole edge 325D defines a through-hole 326D in the vicinity of the first corner portion 321. The hole edge 327D defines a through-hole 328D in the vicinity of the first corner portion 321.

The through-hole 326D is formed substantially directly above the through-hole 336D formed in the middle flange 330D. The lead wire 113 is sequentially inserted into the through-holes 336D and 326D.

The through-hole 328D is formed substantially directly above the through-hole 338D formed in the middle flange 330D. The lead wire 114 is sequentially inserted into the through-holes 338D and 328D.

The upper flange 320D further includes hole edges 375D and 377D. The hole edge 375D defines a through-hole 376D in the vicinity of the third corner portion 323. The hole edge 377D defines a through-hole 378D in the vicinity of the third corner portion 323. A lead wire 123 drawn out from the upper coil portion 121A is inserted from the upper space US into the through-hole 376D. A lead wire 124 drawn out from the upper coil portion 121A is inserted from the upper space US into the through-hole 378D.

Sixth Embodiment

In Second Embodiment through Fourth Embodiment, a lead wire is fixed by being inserted into a cutout portion formed in a bobbin. Alternatively, a lead wire may be fixed on a terminal block incorporated into a bobbin or attached to the bobbin. In Sixth Embodiment, a technique of fixing a lead wire by using a terminal block is described.

Figure 16:
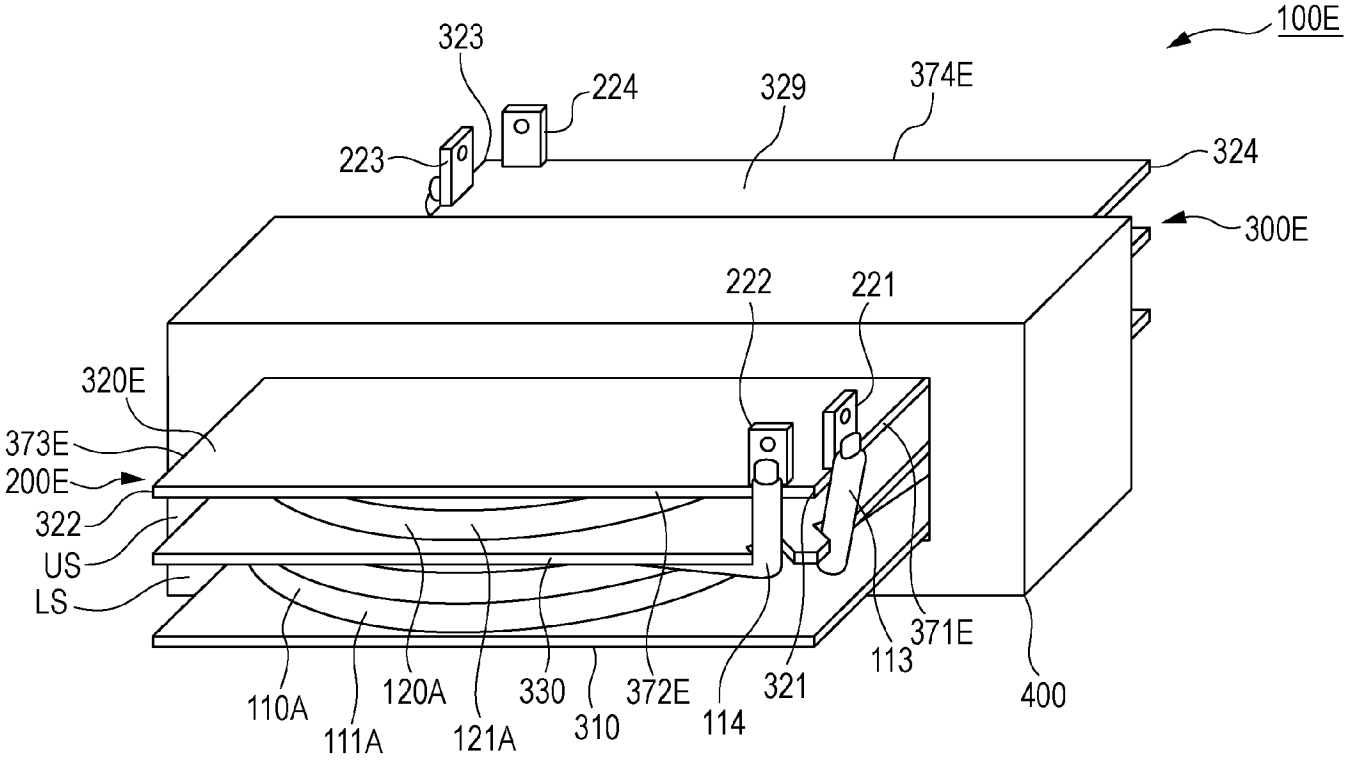
FIG. 16 is a perspective view schematically illustrating a coil structure of Sixth Embodiment.

FIG. 16 is a perspective view schematically illustrating a coil structure 100E of Sixth Embodiment. The coil structure 100E is described with reference to FIGS. 1 and 16. Reference signs common to both Second Embodiment and Sixth Embodiment mean that elements given these reference signs have identical functions to those of Second Embodiment. Therefore, the description in Second Embodiment is incorporated in these elements.

As in Second Embodiment, the coil structure 100E includes a first wire rod 110A, a second wire rod 120A, and a magnetic core 400. The coil structure 100E further includes an insulating structure 200E.

The insulating structure 200E includes a bobbin 300E and terminal blocks 221, 222, 223, and 224. The first wire rod 110A wound around the bobbin 300E is connected to the terminal blocks 221 and 222 by solder. The second wire rod 120A wound around the bobbin 300E is connected to the terminal blocks 223 and 224 by solder.

As in Second Embodiment, the bobbin 300E includes a lower flange 310 and a middle flange 330. The bobbin 300E further includes an upper flange 320E. The upper flange 320E is a plate member that has a substantially square shape and that is disposed above the middle flange 330. An upper space US is formed between the upper flange 320E and the middle flange 330. Note that a designer may design the upper flange 320E in other shapes (e.g., a triangle, an ellipse, or a pentagon). The designer may design the shape of the upper flange 320E in conformity with various design conditions requested for the coil structure 100E. Therefore, the principle of the present embodiment is not limited to a specific shape of the upper flange 320E.

As in Second Embodiment, lead wires 113 and 114 drawn out from a lower coil portion 111A is fixed by the middle flange 330. The lead wires 113 and 114 extend from the middle flange 330 and pass through the upper space US. Then, the lead wires 113 and 114 are fixed on the terminal blocks 221 and 222, respectively.

Figure 17:
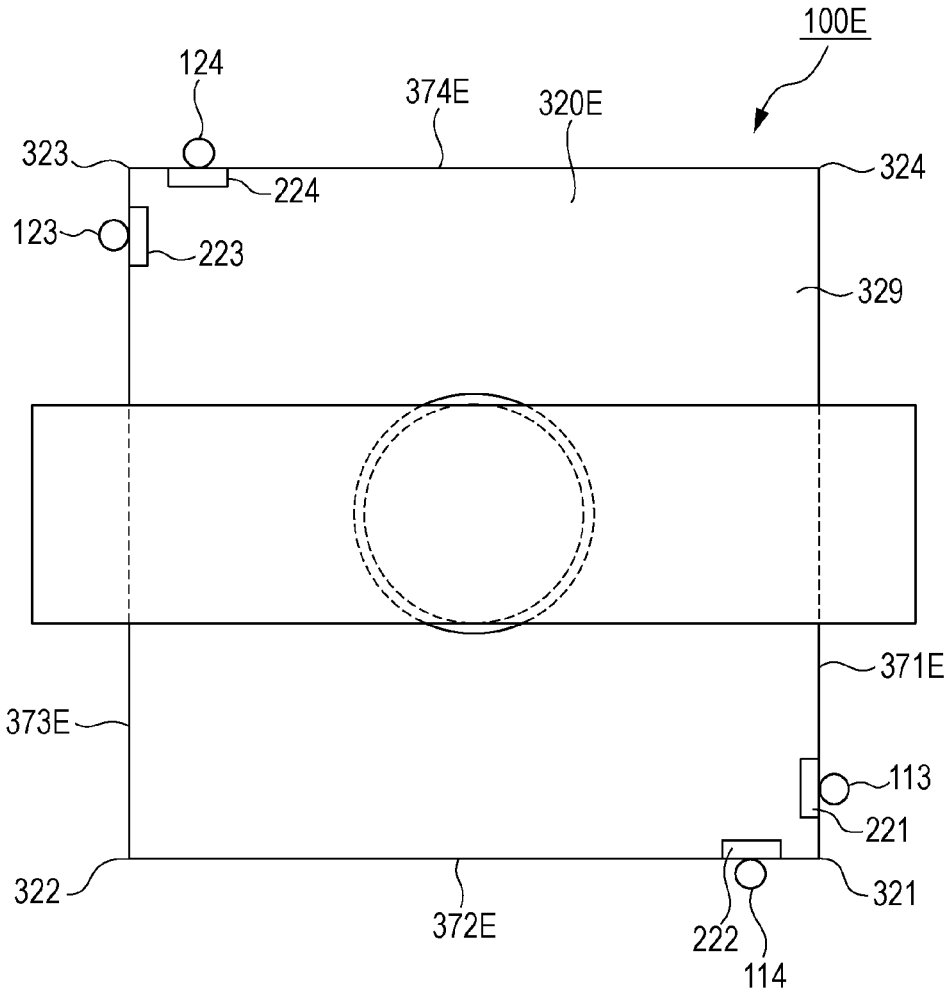
FIG. 17 is a plan view schematically illustrating the coil structure illustrated in FIG. 16.

FIG. 17 is a plan view schematically illustrating the coil structure 100E. The coil structure 100E is further described with reference to FIGS. 16 and 17.

As in Second Embodiment, the upper flange 320E includes a first corner portion 321, a second corner portion 322, a third corner portion 323, and a fourth corner portion 324. The upper flange 320E includes a right edge 371E, a front edge 372E, a left edge 373E, and a rear edge 374E. The right edge 371E extends straight between the fourth corner portion 324 and the first corner portion 321. The front edge 372E extends straight between the first corner portion 321 and the second corner portion 322. The left edge 373E extends straight between the second corner portion 322 and the third corner portion 323. The rear edge 374E extends straight between the third corner portion 323 and the fourth corner portion 324.

The upper flange 320E includes a rectangular upper surface 329 surrounded by the right edge 371E, the front edge 372E, the left edge 373E, and the rear edge 374E. The terminal blocks 221, 222, 223, and 224 are attached onto the upper surface 329.

The terminal block 221 is disposed along the right edge 371E in the vicinity of the first corner portion 321. The lead wire 113 is appropriately fixed by the middle flange 330 and the terminal block 221.

The terminal block 222 is disposed along the front edge 372E in the vicinity of the first corner portion 321. The lead wire 114 is appropriately fixed by the middle flange 330 and the terminal block 222.

The terminal block 223 is disposed along the left edge 373E in the vicinity of the third corner portion 323. A lead wire 123 drawn out from an upper coil portion 121A is appropriately fixed by the terminal block 223.

The terminal block 224 is disposed along the rear edge 374E in the vicinity of the third corner portion 323. A lead wire 124 drawn out from the upper coil portion 121A is appropriately fixed by the terminal block 224.

A manufacturer of the coil structure 100E may solder the lead wires 113, 114, 123, and 124 to the terminal blocks 221, 222, 223, and 224. Alternatively, the manufacturer may use another technique of electrically connecting the lead wires 113, 114, 123, and 124 to the terminal blocks 221, 222, 223, and 224. The principle of the present embodiment is not limited to a specific connecting technique between the lead wires 113, 114, 123, and 124 and the terminal blocks 221, 222, 223, and 224.

Seventh Embodiment

A designer may dispose an additional insulating member besides a bobbin in order to obtain a long spatial distance between a lead wire and an upper coil portion. In Seventh Embodiment, a coil structure having an additional insulating member is described.

Figure 18:
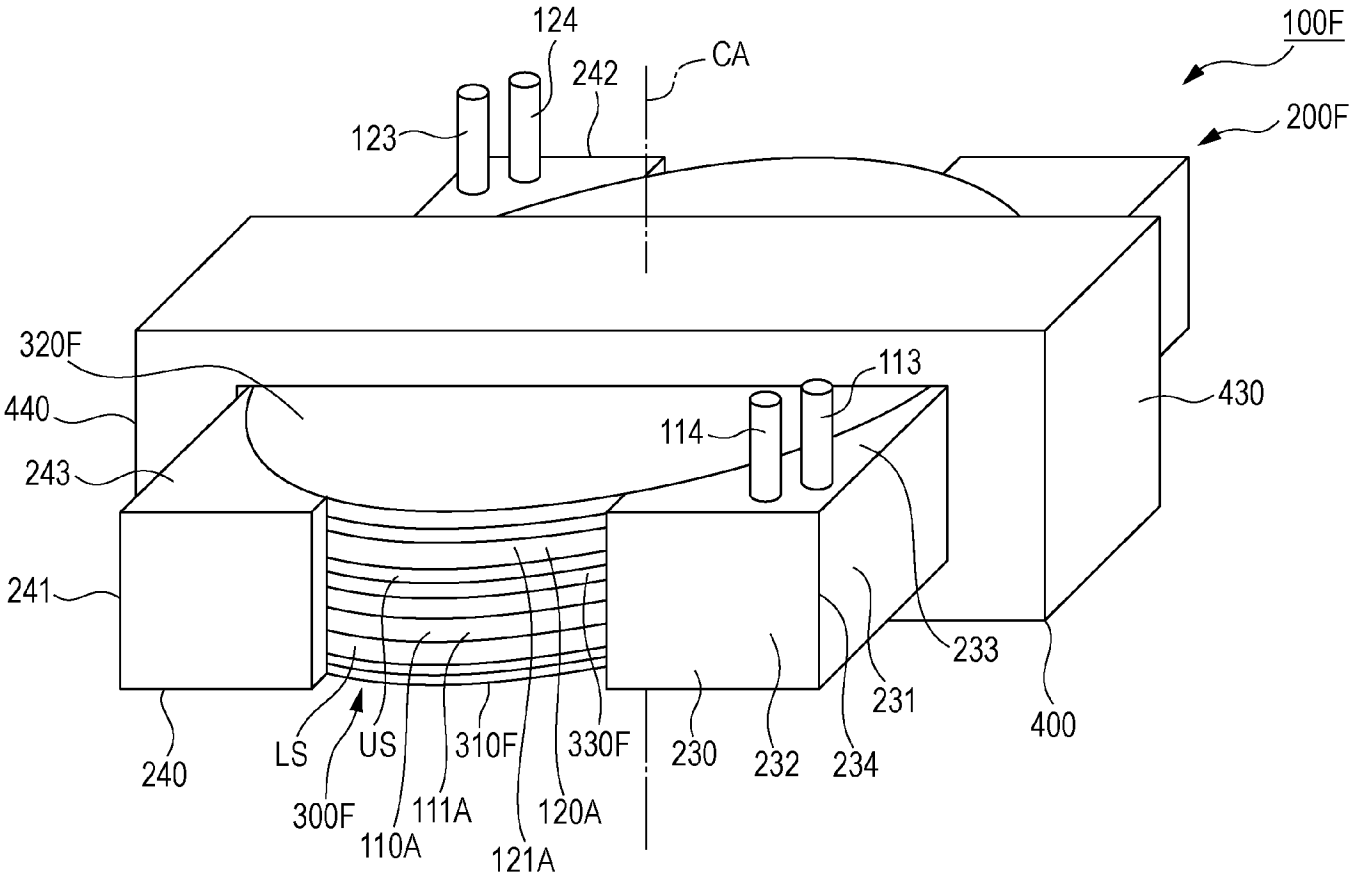
FIG. 18 is a perspective view schematically illustrating a coil structure of Seventh Embodiment.

FIG. 18 is a perspective view schematically illustrating a coil structure 100F of Seventh Embodiment. The coil structure 100F is described with reference to FIG. 18. Reference signs common to both Second Embodiment and Seventh Embodiment mean that elements given these reference signs have identical functions to those of Second Embodiment. Therefore, the description in Second Embodiment is incorporated in these elements.

As in Second Embodiment, the coil structure 100F includes a first wire rod 110A, a second wire rod 120A, and a magnetic core 400. The coil structure 100F further includes an insulating structure 200F.

The insulating structure 200F includes a bobbin 300F, a right insulating block 230, and a left insulating block 240. The right insulating block 230 is disposed between the bobbin 300F and a right magnetic leg 430 that is substantially parallel with a coil axis CA. The left insulating block 240 is disposed between the bobbin 300F and a left magnetic leg 440 that is substantially parallel with the coil axis CA. In the present embodiment, a magnetic leg is exemplified by the right magnetic leg 430.

The bobbin 300F includes a lower flange 310F, a middle flange 330F, and an upper flange 320F. Unlike Second Embodiment, each of the lower flange 310F, the middle flange 330F, and the upper flange 320F has a circular shape.

A lower space LS is formed between the lower flange 310F and the middle flange 330F. A lower coil portion 111A is formed in the lower space LS.

An upper space US is formed between the middle flange 330F and the upper flange 320F. An upper coil portion 121A is formed in the upper space US.

Figure 19:
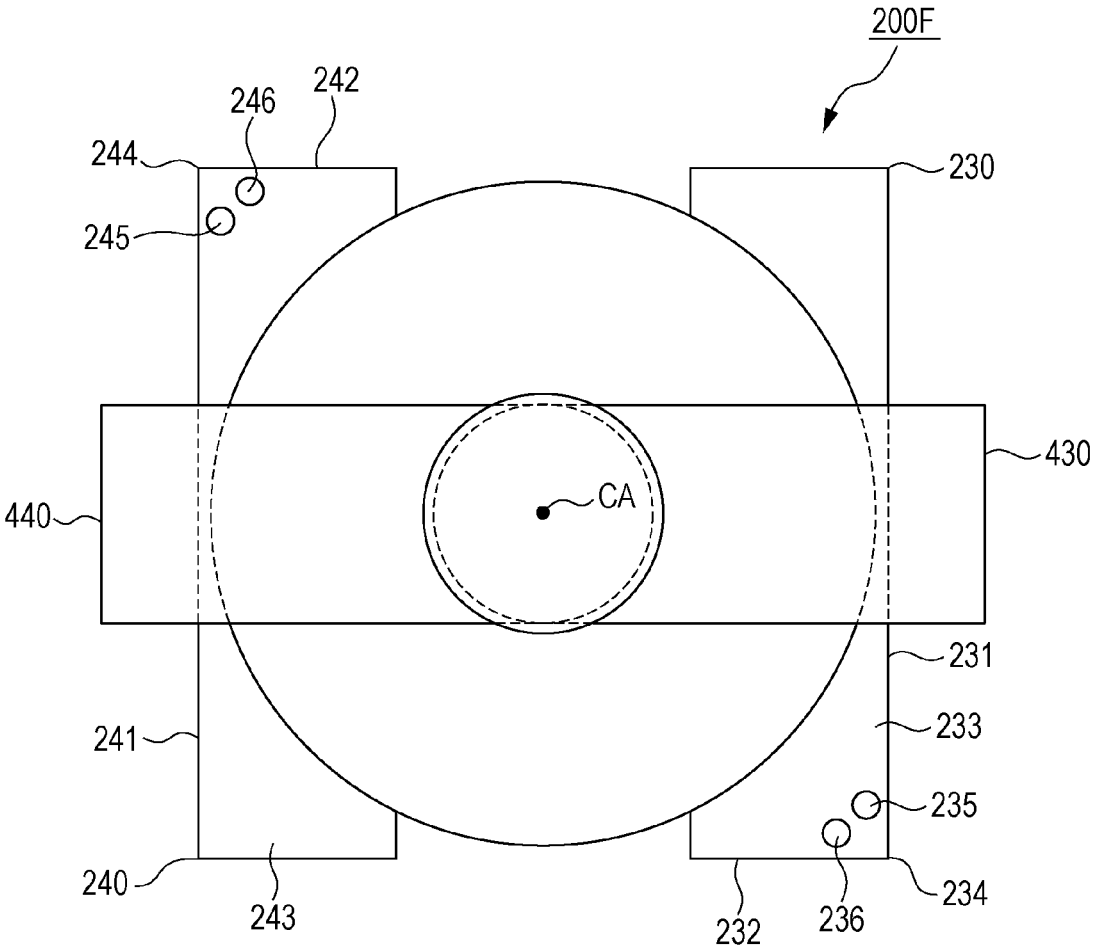
FIG. 19 is a plan view schematically illustrating an insulating structure of the coil structure illustrated in FIG. 18.

FIG. 19 is a plan view schematically illustrating the insulating structure 200F. The insulating structure 200F is described with reference to FIGS. 18 and 19.

The right insulating block 230 includes a right surface 231, a front surface 232, and an upper surface 233. The right surface 231 is in contact with the right magnetic leg 430. The front surface 232 forms a corner portion 234 in cooperation with the right surface 231. Through-holes 235 and 236 are formed in the upper surface 233 in the vicinity of the corner portion 234. The positions of the through-holes 235 and 236 may be determined on the basis of the design principle described in association with Second Embodiment.

A lead wire 113 drawn out from the lower coil portion 111A protrudes out from the upper surface 233 through the through-hole 235. A lead wire 114 drawn out from the lower coil portion 111A protrudes out from the upper surface 233 through the through-hole 236. Therefore, the lead wires 113 and 114 are appropriately fixed by the right insulating block 230. In the present embodiment, a fixing member is exemplified by the right insulating block 230.

The left insulating block 240 includes a left surface 241, a rear surface 242, and an upper surface 243. The left surface 241 is in contact with the left magnetic leg 440. The rear surface 242 forms a corner portion 244 in cooperation with the left surface 241. The coil axis CA is located on a straight line connecting the corner portions 234 and 244.

Through-holes 245 and 246 are formed in the upper surface 243 in the vicinity of the corner portion 244. A lead wire 123 drawn out from the upper coil portion 121A protrudes out from the upper surface 243 through the through-hole 245. A lead wire 124 drawn out from the upper coil portion 121A protrudes out from the upper surface 243 through the through-hole 246. Therefore, the lead wires 123 and 124 are appropriately fixed by the left insulating block 240.

Eighth Embodiment

In Seventh Embodiment, a lead wire is fixed by being inserted into a through-hole. Alternatively, a lead wire is fixed by being inserted into a cutout portion. In Eighth Embodiment, an insulating structure in which a cutout portion is formed is described.

Figure 20:
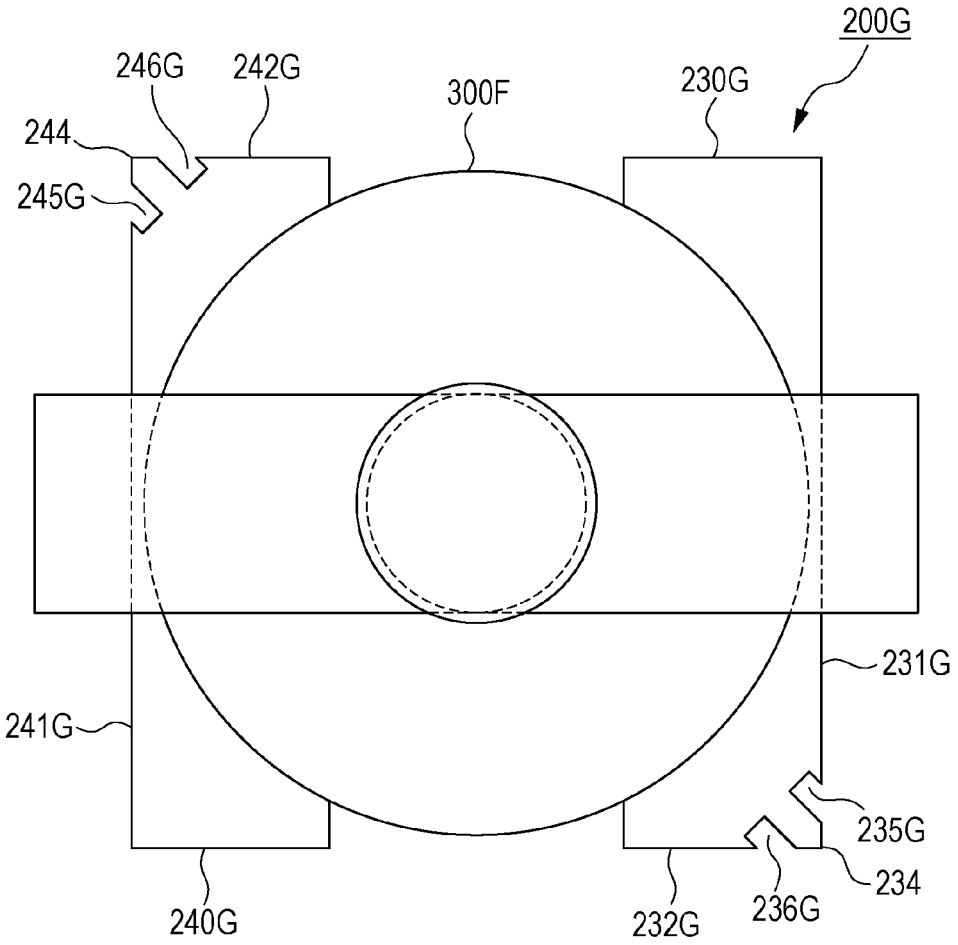
FIG. 20 is a plan view schematically illustrating an insulating structure of Eighth Embodiment.

FIG. 20 is a plan view schematically illustrating an insulating structure 200G of Eighth Embodiment. The insulating structure 200G is described with reference to FIG. 20. Reference signs common to both Seventh Embodiment and Eighth Embodiment mean that elements given these reference signs have identical functions to those of Seventh Embodiment. Therefore, the description in Seventh Embodiment is incorporated in these elements.

As in Seventh Embodiment, the insulating structure 200G includes a bobbin 300F. The insulating structure 200G further includes a right insulating block 230G and a left insulating block 240G.

As in Seventh Embodiment, the right insulating block 230G includes a corner portion 234. The right insulating block 230G includes a right surface 231G and a front surface 232G. The corner portion 234 is formed between the right surface 231G and the front surface 232G.

A cutout portion 235G is formed in the right surface 231G in the vicinity of the corner portion 234. A cutout portion 236G is formed in the front surface 232G in the vicinity of the corner portion 234.

As in Seventh Embodiment, the left insulating block 240G includes a corner portion 244. The left insulating block 240G includes a left surface 241G and a rear surface 242G. The corner portion 244 is formed between the left surface 241G and the rear surface 242G.

A cutout portion 245G is formed in the left surface 241G in the vicinity of the corner portion 244. A cutout portion 246G is formed in the rear surface 242G in the vicinity of the corner portion 244. A lead wire is fixed by the cutout portions 235G, 236G, 245G, and 246G.

Ninth Embodiment

A coil structure created on the basis of the various embodiments described above may be incorporated, as a transformer, into an electric power conversion device that converts an alternating electric current to a direct electric current. In this case, the electric power conversion device may be incorporated into a charging device in which electrical energy is stored. In Ninth Embodiment, an electric power conversion device having a coil structure created on the basis of the various embodiments described above is described.

Figure 21:
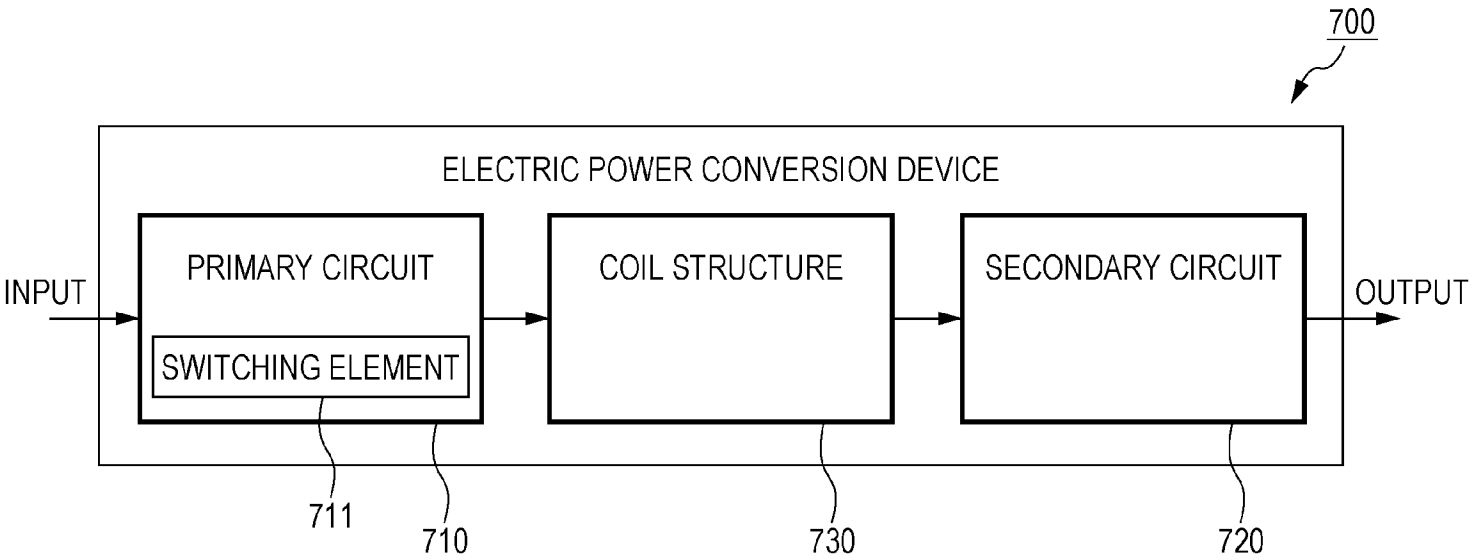
FIG. 21 is a block diagram schematically illustrating an electric power conversion device of Ninth Embodiment.

FIG. 21 is a block diagram schematically illustrating an electric power conversion device 700 of Ninth Embodiment. The electric power conversion device 700 is described with reference to FIG. 21.

The electric power conversion device 700 includes a primary circuit 710, a secondary circuit 720, and a coil structure 730. The primary circuit 710 includes a switching element 711. An ON timing and an OFF timing of the switching element 711 may be adjusted so that a voltage of the secondary circuit 720 is stabilized. In the present embodiment, a switching circuit is exemplified by the primary circuit 710.

The coil structure 730 may be formed on the basis of any of the principles of the various embodiments described above. Alternatively, the coil structure 730 may be formed on the basis of a combination of the principles of the various embodiments described above.

The coil structure 730 may function as a transformer that insulates the secondary circuit 720 from the primary circuit 710.

The electric power conversion device 700 may convert an alternating electric current supplied to the primary circuit 710 to a direct electric current. In this case, the electric power conversion device 700 may be incorporated into a charging device.

The principles of the various embodiments described above may be combined in conformity with the usage of the coil structure and properties requested for the coil structure.

The principles of the various embodiments described above may be suitably used in various devices utilizing electromagnetic induction.

What is claimed is:

1. A coil structure comprising:

a first wire rod including a first coil portion and a first lead wire portion, the first coil portion winding around a coil axis in a first space, the first lead portion being connected to the first coil portion;

a second wire rod including a second coil portion, the second coil portion winding around the coil axis in a second space, the second space being aligned with the first space along the coil axis; and an insulating structure including a first insulating section, the first insulating section insulating the first coil portion from the second coil portion, wherein:

the first lead wire portion extends through the second space; and the insulating structure fixes the first lead wire portion at a position, the position being away from the second coil portion by not less than a minimum creepage distance between the first coil portion and the second coil portion, the minimum creepage distance being defined by the first insulating section.

2. The coil structure according to claim 1, wherein:

the first insulating section includes a first surface, a second surface and an edge surface, the first surface facing the first coil portion, the second surface facing the second coil portion, the edge surface defining outer contours of the first surface and the second surface;

the minimum creepage distance is defined on a first plane on which a sum of a first creepage distance, a second creepage distance and a third creepage distance is minimum, the first creepage distance being a distance on the first surface between an outermost edge of the first coil portion and the edge surface, the second creepage distance being a distance on the second surface between an outermost edge of the second coil portion and the edge surface, the third creepage distance being a distance on the edge surface between the first surface and the second surface; and the first lead wire portion is fixed on a second plane different from the first plane.

3. The coil structure according to claim 2, wherein the first insulating section includes a first fixing edge that fixes the first lead wire portion.

4. The coil structure according to claim 3, wherein:

the first fixing edge includes a cutout portion being recessed in the edge surface; and the first lead wire portion is inserted into the cutout portion.

5. The coil structure according to claim 3, wherein:

the first fixing edge includes a through-hole penetrating the first insulating section from the first surface to the second surface; and the first lead wire portion is inserted into the through-hole.

6. The coil structure according to claim 3, wherein:

the first wire rod includes a second lead wire portion being connected to the first coil portion, the second lead wire portion being connected to the first lead wire portion through the first coil portion;

the second lead wire portion extends through the second space; and the first insulating section includes a second fixing edge that fixes the second lead wire portion.

7. The coil structure according to claim 6, wherein the second lead wire portion sterically crosses the first lead wire portion in the first space.

8. The coil structure according to claim 6, wherein the second lead wire portion extends from the first coil portion in a direction in which the second lead wire portion leaves from the first lead wire portion in the first space.

9. The coil structure according to claim 3, further comprising a magnetic core that defines a magnetic path surrounding the first coil portion and the second coil portion, wherein:

the insulating structure includes a second insulating section that faces the first insulating section, the second insulating section insulating the second coil portion from the magnetic core; and the second insulating section fixes the first lead wire portion in cooperation with the first insulating section.

10. The coil structure according to claim 1, wherein:

the insulating structure includes a terminal block that fixes the first lead wire portion.

11. The coil structure according to claim 2, further comprising a magnetic core that defines a magnetic path surrounding the first coil portion and the second coil portion, wherein:

the magnetic core includes a magnetic leg located outside of the first coil portion and the second coil portion; and the insulating structure includes a fixing member located between the magnetic leg and the edge surface, the fixing member fixing the first lead wire portion.

12. The coil structure according to claim 6, wherein the second wire rod includes a third lead wire portion that is connected to the second coil portion, the third lead wire portion extending along a direction in which the first lead wire portion extends.

13. An electric power conversion device comprising:

a coil structure; and a switching circuit that includes a switching element, wherein the coil structure comprises:

a first wire rod including a first coil portion and a first lead wire portion, the first coil portion winding around a coil axis in a first space, the first lead portion being connected to the first coil portion;

a second wire rod including a second coil portion, the second coil portion winding around the coil axis in a second space, the second space being aligned with the first space along the coil axis; and an insulating structure including a first insulating section, the first insulating section insulating the first coil portion from the second coil portion, wherein:

the first lead wire portion extends through the second space; and the insulating structure fixes the first lead wire portion at a position, the position being away from the second coil portion by not less than a minimum creepage distance between the first coil portion and the second coil portion, the minimum creepage distance being defined by the first insulating section.

* * * * *